US006084354A

United States Patent [19]

Kohmura et al.

[11] Patent Number: 6,084,354

[45] Date of Patent: Jul. 4, 2000

[54] VEHICLE-LAMP LIGHTING-ON DEVICE

[75] Inventors: Yoshihiko Kohmura, Nisshin; Takafumi Oshima, Nagoya; Toshiharu Ito, Matsuzaka; Noriyasu Sugimoto, Konan; Minoru Yasuda, Nagoya, all of Japan

[73] Assignee: NGK Spark Plug Co., Ltd., Nagoya, Japan

[21] Appl. No.: 09/035,356

[22] Filed: Mar. 5, 1998

[30] Foreign Application Priority Data

| | | | |
|---|---|---|---|
| Mar. 6, 1997 | [JP] | Japan | 9-070508 |
| Mar. 7, 1997 | [JP] | Japan | 9-070510 |
| Apr. 23, 1997 | [JP] | Japan | 9-105564 |
| Jun. 16, 1997 | [JP] | Japan | 9-176354 |

[51] Int. Cl.[7] ..... H01J 7/44

[52] U.S. Cl. ..... 315/57; 315/77; 315/85; 336/145; 336/181; 362/61; 362/265

[58] Field of Search ..... 315/56, 57, 70, 315/77, 85, 276, 254, 266, 282, 279, 239; 307/10.1, 10.8; 361/600, 620, 623, 739, 748; 336/145, 181, 220, 221; 362/61, 65, 201, 265

[56] References Cited

U.S. PATENT DOCUMENTS

| | | | |
|---|---|---|---|
| 3,894,266 | 7/1975 | Souza | 315/227 R |
| 5,264,997 | 11/1993 | Hutchisson et al. | 362/226 |
| 5,600,208 | 2/1997 | Katou et al. | 315/70 |
| 5,604,406 | 2/1997 | Gaus | 315/56 |

FOREIGN PATENT DOCUMENTS

| | | |
|---|---|---|
| 2712 959-A1 | 6/1995 | France . |
| 12 21355 | 7/1966 | Germany . |
| 33 12 933A1 | 10/1984 | Germany . |
| 8-315631 | 11/1966 | Japan . |
| 57-176602 | 10/1982 | Japan . |
| 59-130002 | 7/1984 | Japan . |
| 7-114805 | 5/1995 | Japan . |
| 8-315624 | 11/1996 | Japan . |
| 8-315630 | 11/1996 | Japan . |

*Primary Examiner*—Haissa Philogene
*Attorney, Agent, or Firm*—Morgan, Lewis & Bockius LLP

[57] ABSTRACT

In the vehicle-lamp lighting-on device, a body case has a connection opening formed in the front end thereof. A lighting-on transformer is disposed within the body case. The transformer includes a core housing with an iron core and a coil bobbin with a secondary coil wound thereon. The connection opening of the body case is shielded at the front end of the lighting-on transformer. A socket for receiving a vehicle discharge lamp includes a high-voltage terminal and low-voltage terminals. When the socket is inserted into the connection opening of the body case, the high-voltage terminal of the socket is connected to the high-voltage side terminal of the lighting-on transformer, and the low-voltage terminals are connected to the low-voltage side terminals. The connection opening of the body case is shielded by the front surface (made of insulating material) of the lighting-on transformer. The vehicle-lamp lighting-on device can be completed by merely attaching the socket to the assembly of the lighting-on transformer and the body case. Therefore, the assembly of the device is easy. Further, the height of the vehicle-lamp lighting-on device is reduced overall since there is no need to form a wall corresponding to the shielding member in the body case.

10 Claims, 27 Drawing Sheets

VEHICLE-LAMP LIGHTING-ON DEVICE

BACKGROUND OF THE INVENTION

1. Field of the Invention

The present invention relates to a vehicle-lamp lighting-on device for lighting a vehicle lamp e.g., a head lamp, attached thereto.

2. Description of the Related Art

A discharge lamp, e.g., a metal halide lamp, is used for a head lamp of a vehicle. The discharge lamp is detachably attached to a socket provided in the front of the vehicle. Electrodes of the discharge lamp are connected to the terminals of the socket. In this example, electric power is supplied from a power source through the socket terminals to the discharge lamp to light the lamp. The power source supplies voltage of about 400V to a lighting-on transformer. The transformer then boosts the voltage and produces a high voltage at the secondary coil thereof, and applies it to the socket terminals. The lighting-on transformer is provided outside the lamp housing having the socket therein. A high voltage cable is led out of the secondary terminal of the transformer, introduced into the lamp housing, and connected to the terminals of the socket.

Thus, the socket and the lighting-on transformer are separately located, and they are connected by the high voltage cable. The conventional vehicle-lamp lighting-on device has the following problems: 1) the number of required component parts is large; 2) mounting of those component parts is troublesome; 3) use of the high voltage cable restricts to design the components layout; 4) electromagnetic waves generated from the high voltage cable interferes with the electronic control circuitry located therearound, causing it to erroneously operate; 5) power loss is caused by the high voltage cable; and 6) others.

To solve the problems, there is proposed a vehicle-lamp lighting-on device having the following construction. A socket, which receives a discharge lamp, is attached to a body case and protrudes from one side of the body case. A lighting-on transformer is placed in the body case. In the transformer, a coil bobbin, made of insulating material, is wound by a secondary coil. A core housing includes an iron core formed therein. The coil bobbin is put in and fit to the iron core of the core housing.

The socket is inserted into the body case, and the lighting-on transformer is connected to the terminals of the socket within the body case. Therefore, the lighting-on device does not need the high voltage cable for connecting the lighting-on transformer and the socket.

SUMMARY OF THE INVENTION

It is an object of the present invention is to provide a vehicle-lamp lighting-on device which is easy to assemble and low in height.

A vehicle-lamp lighting-on device according to the present invention comprises: a body case including a connection opening formed in the front end thereof; a lighting-on transformer being disposed within the body case, the lighting-on transformer comprising: a core housing having an iron core; a coil bobbin comprising an insulating material, the coil bobbin being installed outside of the iron core; a secondary coil wound on an outer periphery of the coil bobbin; a primary coil wound on a periphery of the coil bobbin; a high-voltage side terminal connected to the secondary coil; low-voltage side terminals connected to a low-voltage path introduced into the body case, the high-voltage side terminal and the low-voltage side terminals being provided in a front surface of the lighting-on transformer; an insulating shield plate for shielding the connection opening of the body case; wherein the high-voltage side terminal and the low-voltage side terminals are exposed in the connection opening; and a socket connected to a vehicle lamp, in which a high-voltage terminal and low voltage terminals are held by an ring-shaped holding piece having an insulating material; wherein the socket is connected to the connection opening so that the high-voltage terminal and the low-voltage side terminals are connected to the high-voltage side terminal and the low-voltage terminals, respectively.

The front end surface of the lighting-on transformer serves as a shield surface for covering the connection opening of the body case. Therefore, the necessity of forming a wall covering the connection opening in the body case or the socket is eliminated.

A vehicle-lamp lighting-on device according to the present invention comprises: a body case including a connection opening formed in the front end thereof; a lighting-on transformer being disposed within the body case, the lighting-on transformer comprising: a core housing having an iron core; a coil bobbin comprising an insulating material, the coil bobbin being installed outside of the iron core; a secondary coil wound on an outer periphery of the coil bobbin; a primary coil wound on a periphery of the coil bobbin; wherein the lighting-on transformer is received in the body case; a socket connected to the connection opening of the body case, the socket having a high-voltage terminal which is connected to a high-voltage end of the secondary coil; a front end plate which is provided offset from the coil bobbin so that an insertion gap is formed between the front end plate and a bobbin main portion of the coil bobbin for carrying the secondary coil; wherein the core housing comprises a plate-shaped core block having a thickness equal to the insertion gap and a cylindrical core block formed of a cylindrical wall and a rear wall which interconnects the cylindrical wall and the iron core, the plate-shaped core block is inserted into the gap between the bobbin main portion and the front end plate; and the cylindrical core block is installed outside of the bobbin main portion.

Therefore, the lighting-on transformer is constructed in a simple manner where the plate-like core block is inserted into the gap in the front end of the coil bobbin and the tubular core block installed around to the bobbin frame. The lighting-on transformer is neat and orderly. This results in an easy layout design for the body case and a size reduction of the body case.

A vehicle-lamp lighting-on device according to the present invention comprises: a housing made of insulating material; a circuit board mounted in the housing, a primary current generating circuit connected to a power supply being mounted on the circuit board; a transformer, located on the circuit board, for boosting a voltage of the primary current to generate a secondary voltage; and a socket having a high-voltage terminal for receiving the secondary voltage from the transformer and socket earth terminal, the socket being provided on one end surface of the housing, a discharge lamp being to be attached to the socket; wherein leads for the high-voltage terminal and the socket earth terminal are extend downward through a bottom wall of the socket, and are inserted into the high-voltage terminal and the socket earth terminal provided on one end surface of the transformer.

With such a construction, the socket is connected to the transformer by merely inserting the lower part of the socket into the transformer provided on the circuit board. Therefore, assembly is easy and the discharge lamp devices are efficiently manufactured. Further, when compared with the prior device in which the insulated lead wires are soldered for their connections, the high voltage circuit is reduced in length, thereby reducing noise generation and current leakage.

A vehicle-lamp lighting-on device according to the present invention comprises: a body case having a connection opening formed in the front end thereof; a lighting-on transformer comprising: a core housing having an iron core; a coil bobbin comprising an insulating material, the coil bobbin being installed outside of the iron core; a secondary coil wound on an outer periphery of the coil bobbin; a primary coil wound on a periphery of the coil bobbin; a high-voltage side connecting terminal provide in the front thereof, which is connected to the secondary coil; wherein the lighting-on transformer is disposed within the body case, and the high-voltage side connecting terminal is exposed to the connection opening; a low-voltage side connecting terminal fixed to a fixing portion formed on the body case, which is exposed in the connection opening; a low-voltage path member in which one end is connected to the low-voltage side connecting terminal and the other end is connected to a low-voltage path on a print board stored in a rear portion of the body case, the low-voltage path member being integrally held in the body case by insert molding; and a socket for receiving a vehicle discharge lamp, the socket having ring-like holder, made of insulating material, for holding a high-voltage terminal and low-voltage terminals; wherein the socket is inserted into and attached to the connection opening so that the high-voltage terminal is connected to the high-voltage side connecting terminal and the low-voltage terminals are connected to the low-voltage side connecting terminal.

In the vehicle-lamp lighting-on device thus assembled, the low-voltage metal pieces are insert-molded into the body case. Therefore, the vehicle-lamp lighting-on device is constructed by inserting the lighting-on transformer into the body case, attaching the high-voltage side connecting means and the low-voltage side connecting pieces, and attaching the socket.

A vehicle-lamp lighting-on device according to the present invention comprises: a body case having a connection opening formed in the front end thereof; a lighting-on transformer comprising: a core housing having an iron core; a coil bobbin comprising an insulating material, the coil bobbin being installed outside of the iron core; a secondary coil wound on an outer periphery of the coil bobbin; a primary coil wound on a periphery of the coil bobbin; a high-voltage side connecting terminal provide in the front thereof, which is connection to the secondary coil; wherein the lighting-on transformer is disposed within the body case; a socket which is integrally formed with the body case in a state that the socket is located on a front side of the body case, the socket having low-voltage terminals integrally molded and a high-voltage terminal integrally molded, a vehicle discharge lamp being attached to the socket, within the body case; wherein the high-voltage terminal is electrically connected to high-voltage side connecting terminal of the lighting-on transformer, and the low-voltage terminals are electrically connected to a low-voltage path on a printed circuit board that is located in the rear part within the body case, through earthing path members being insert molded into the body case.

Thus, the body case and the socket including the low-voltage metal pieces and high- and low-voltage terminals are assembled in a unit form. Therefore, the basic portion of the vehicle-lamp lighting-on device can be constructed by merely inserting the lighting-on transformer into the body case. The assembly of the vehicle-lamp lighting-on device is easy.

PREFERRED EMBODIMENTS OF THE INVENTION

Preferred embodiments of a vehicle-lamp lighting-on device according to the present invention will be described referring to the accompanying drawings.

First Embodiment

A vehicle-lamp lighting-on device 1 which is an embodiment of the present embodiment will be described with reference to the accompanying drawings.

Figure 1:
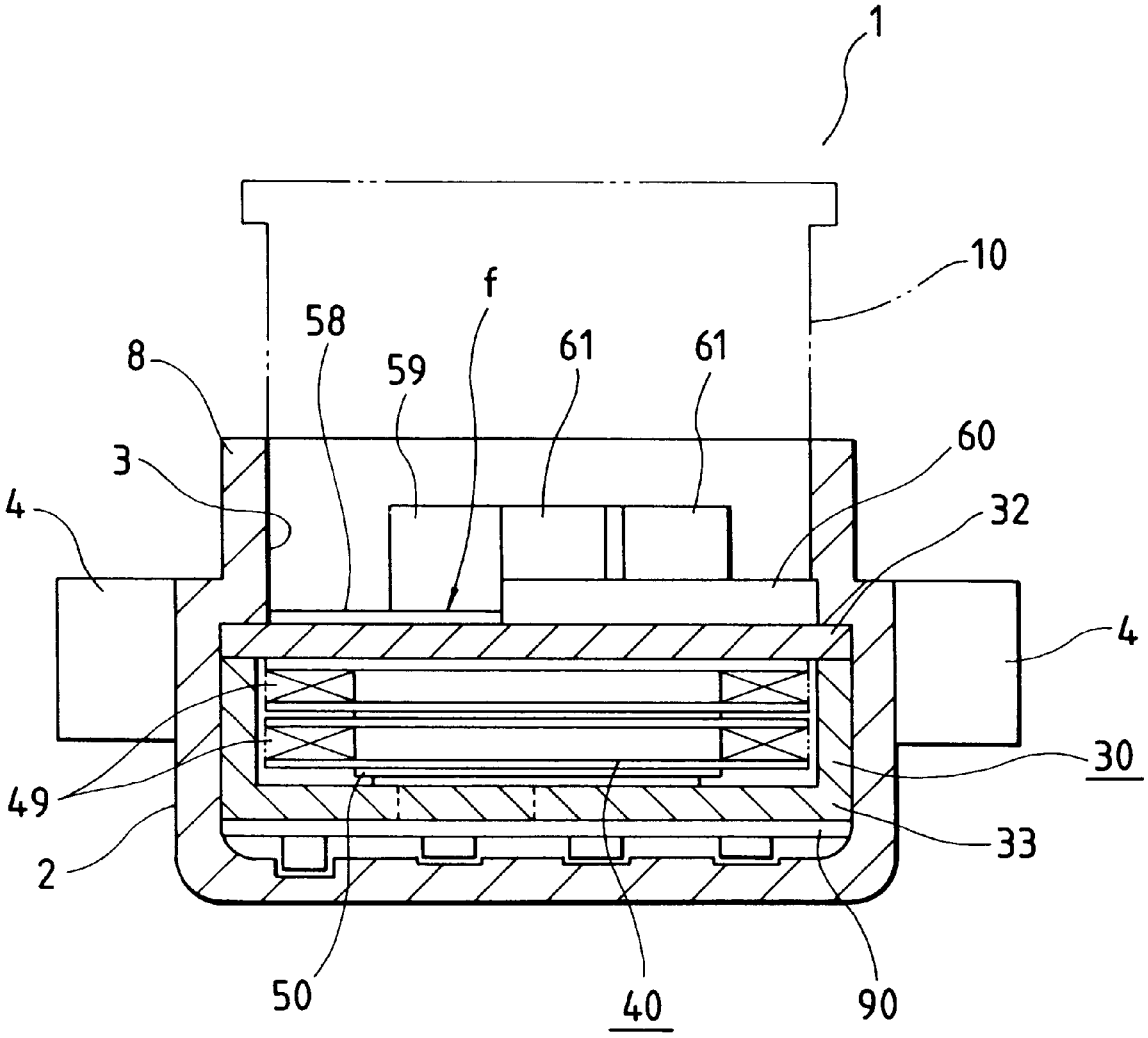
FIG. 1 is a longitudinal sectional view showing a vehicle-lamp lighting-on device according to a first embodiment of the present invention.

The vehicle-lamp lighting-on device 1, as shown in FIG. 1, is generally made up of a body case 2, a socket 10 and a lighting-on transformer 30, and the like. The body case 2 and the socket 10 are both made of synthetic resin.

Figure 2:
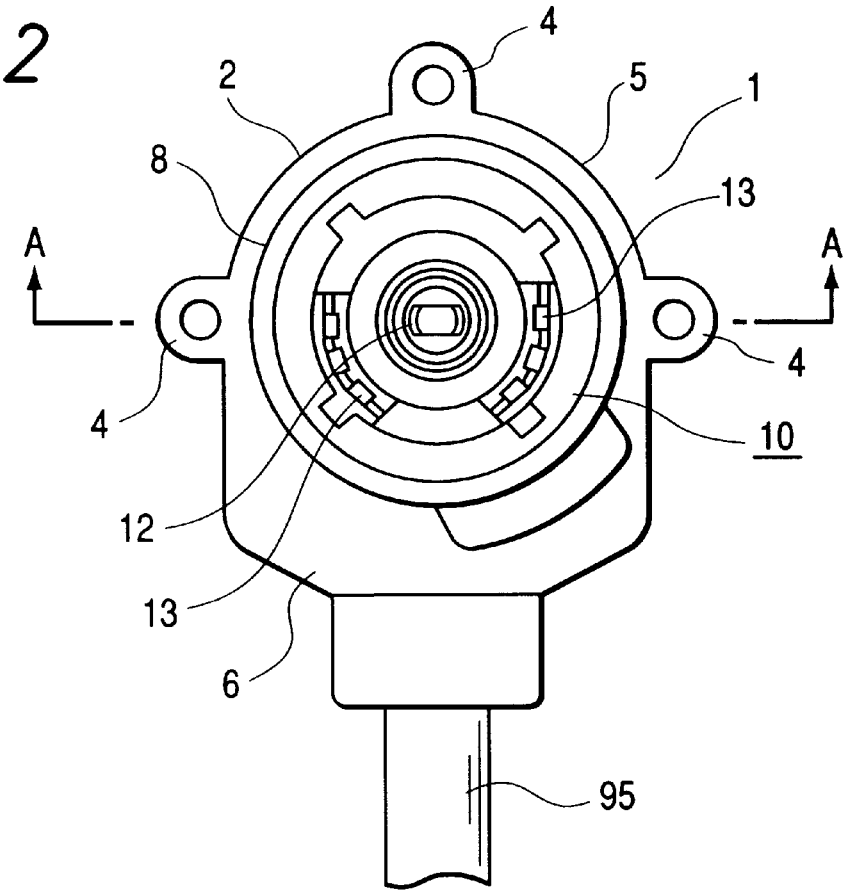
FIG. 2 is a plan view showing the vehicle-lamp lighting-on device.
Figure 3:
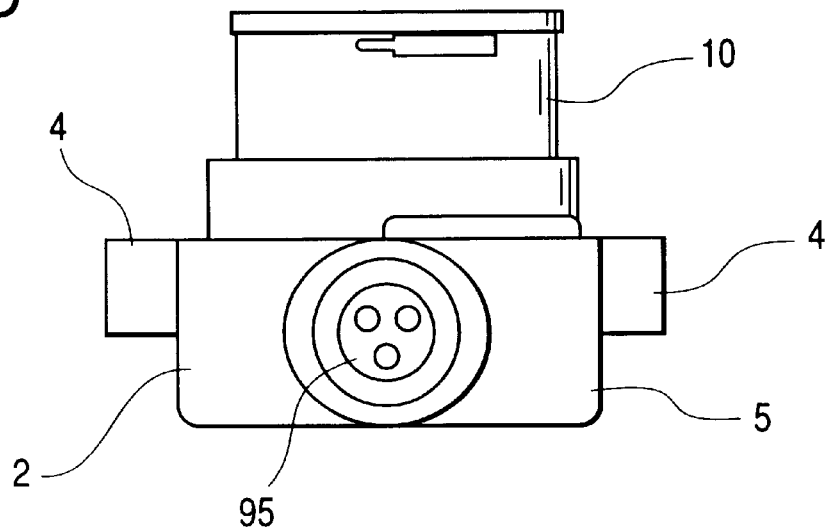
FIG. 3 is a side view showing the vehicle-lamp lighting-on device.
Figure 4:
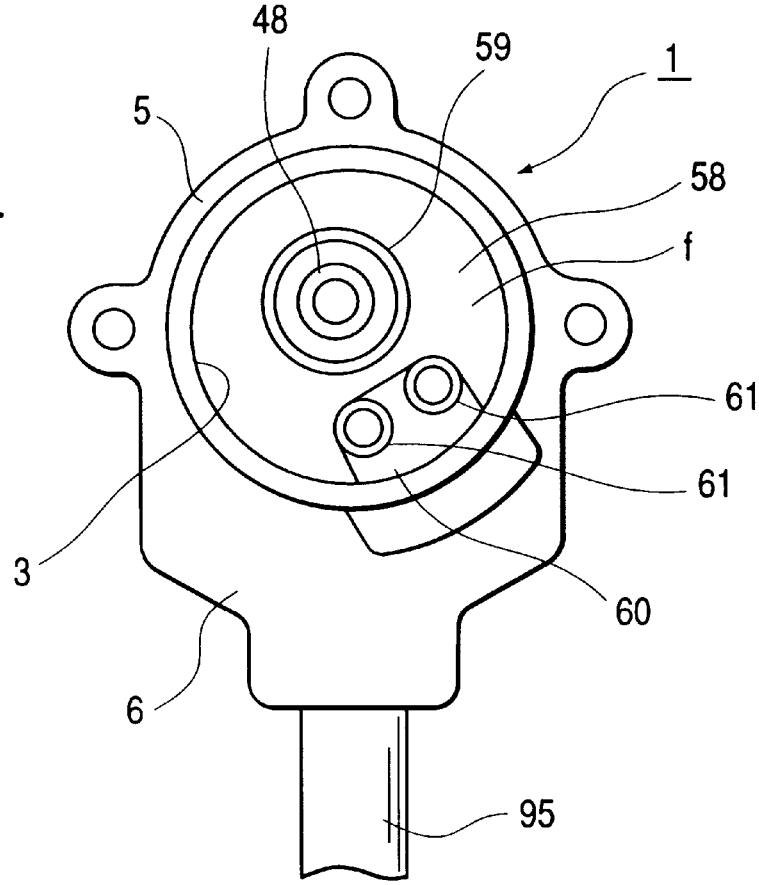
FIG. 4 is a plan view showing the vehicle-lamp lighting-on device when a socket is removed.
Figure 5:
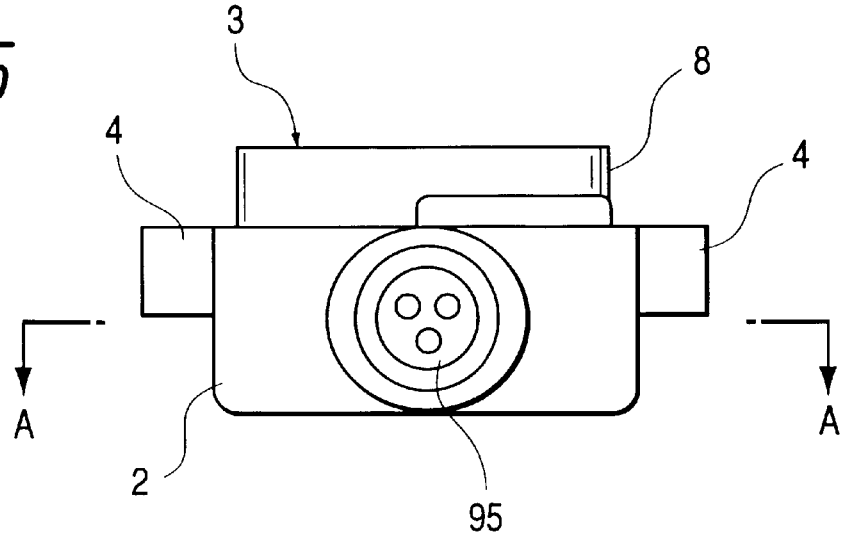
FIG. 5 is a side view showing the vehicle-lamp lighting-on device when a socket is removed.
Figure 6:
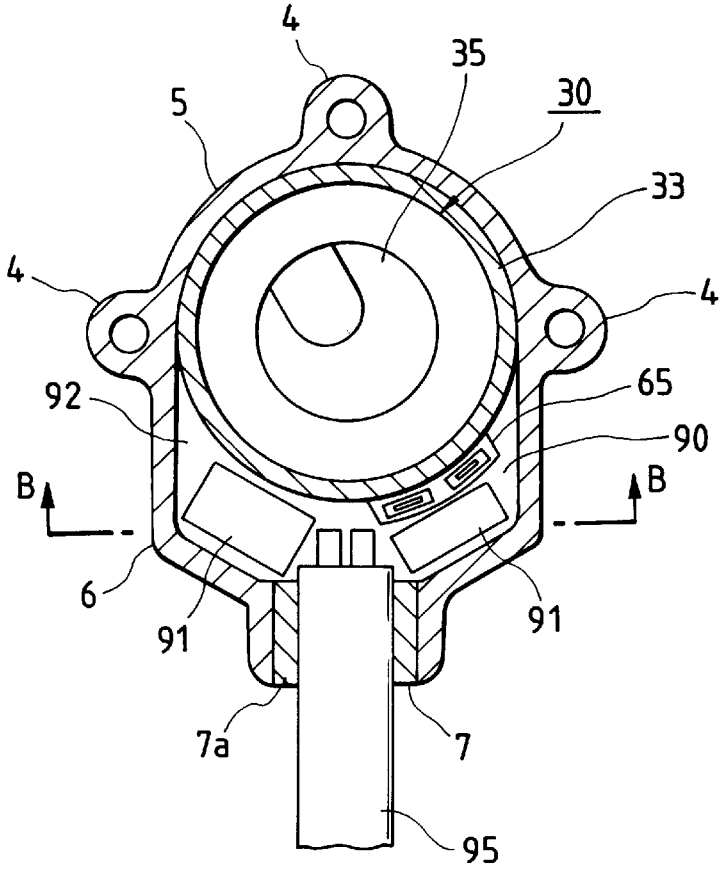
FIG. 6 is a cross sectional view taken on line A—A in FIG. 5.
Figure 7:
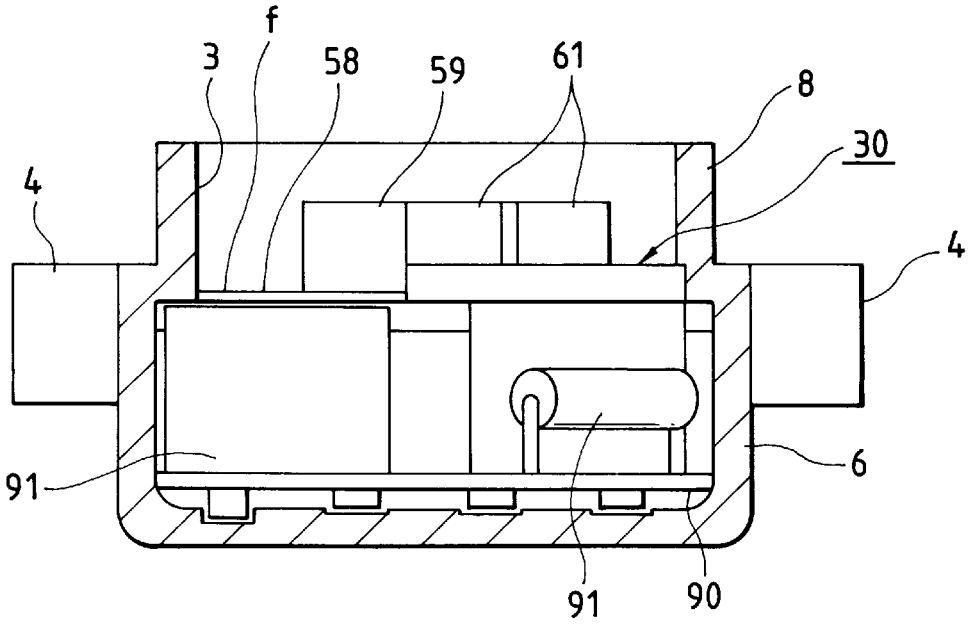
FIG. 7 is a cross sectional view taken on line B—B in FIG. 6.

As typically shown in FIG. 2, the synthetic resin body case 2 includes a circular portion 5 and an extended portion 6 extended outwardly of the circular portion 5. The front end of the circular portion 5 is opened to provide a circular connection opening 3 defined by a ring-like circumferential wall 8. A plural number of mounting portions 4 are protruded outward from the circumferential outer surface of the circular portion 5 of the body case 2. The extended portion 6 is somewhat U-shaped when viewed from above. A cylindrical protrusion, which has a through-hole 7 longitudinally formed therein, is protruded outward from the central part of the bottom of the U-shaped extended portion 6 (FIG. 6). A lead wire (shield cable) 95 is lead out through the through-hole 7 of the cylindrical portion. Within the through-hole 7, a sealing member 7*a*, e.g., a seal ring or sealing rubber tube, is inserted between the lead wire 95 and the inner wall of the through-hole 7, whereby the through-hole 7 having the lead wire 95 inserted thereinto is sealed. A printed circuit board 90 is placed on the bottom surface of the body case 2. A space 92 is formed in the extended portion 6 of the body case 2. The space is used for mounting a circuit component 91, e.g., a condenser, on the printed circuit board 90 (FIGS. 6 and 7). A specific example of the body case 2, actually designed, was 18.6 mm in height and included a circular portion of the connection opening 3 with an inside diameter of 36 mm.

Figure 11:
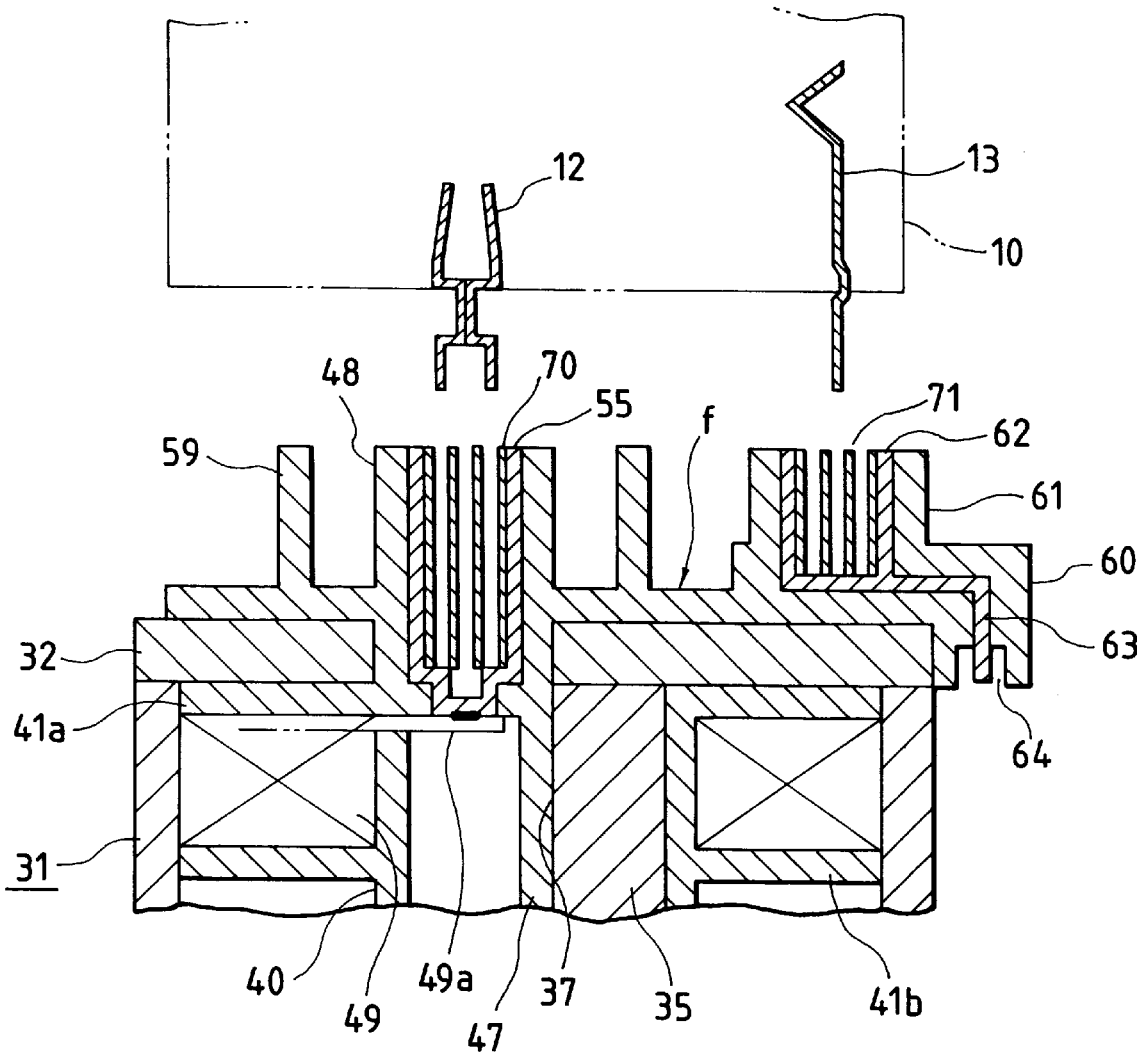
FIG. 11 is a cross sectional view showing how the socket is connected to a core housing.

The socket 10 is inserted into the connection opening 3 of the circular portion 5 of the body case 2. The socket 10, cylindrical in shape, includes a high-voltage terminal 12 located at the central part thereof and a couple of low-voltage terminals 13 (FIGS. 2 and 11, one low-voltage terminal is illustrated in FIG. 11), which are located around and spaced apart from the high-voltage terminal 12 with bifurcated ends. The reason why two low-voltage terminals are used is that it is necessary to prevent an aerial discharge from taking place between the high-voltage terminal and the low-voltage terminals when the vehicle discharge lamp is not attached to the socket.

Construction of the lighting-on transformer 30 will be described with reference to FIGS. 8 through 11.

A coil bobbin 40 is integrally formed within a core housing 31 of a lighting-on transformer 30 having an iron core.

The core housing 31 is made of magnetic material, e.g., ferrite. A couple of core blocks 32 and 33, the outside diameters of which are equal, are coupled together into a cylindrical body of a short length, to form the core housing 31. The outside diameter of the cylindrical body is selected to be equal to the inside diameter of the circular portion 5 of the body case 2. A specific example of the cylindrical block as constructed is 11.4 mm in height and 36 mm in diameter.

The core block 32 of the core housing 31 is a thin disc-like member approximately 2 mm thick. A coil bobbin 40 is injection molded onto the core block 32 thereby forming a single unit.

Figure 9:
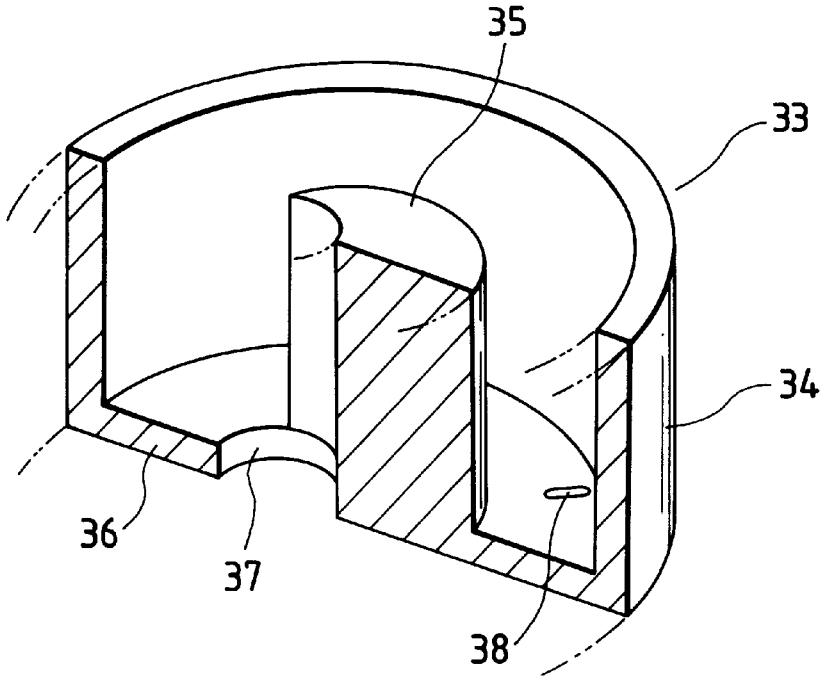
FIG. 9 is a longitudinal sectional view in perspective of a core block.

The detail of the core block 33 of the core housing 31 is illustrated in FIG. 9. As shown, the core block 33 includes a cylindrical wall 34, an iron core 35 and a rear wall 36 which interconnects the cylindrical wall 34 and the iron core 35. The cylindrical wall 34 is raised vertically from the outer circumferential edge of the rear wall 36. The iron core 35 is raised vertically from the central part of the core block 33. A through-hole 37 is extended passing through the iron core 35 in its lengthwise direction deviated from the center of the core block 33. A cylindrical connection part 47 of the coil bobbin 40 (which will be described later) is inserted into the through-hole 37. The core block 33 is manufactured as an individual component part, and, during assembly, receives the unitary structure including the core block 32 and the coil bobbin 40 (will be described later). If required, the iron core 35 may be provided in the core block 32, which is located on the front side of the core block 33.

A construction of the coil bobbin 40 to be integrated with the core block 32 will be described.

Figure 8:
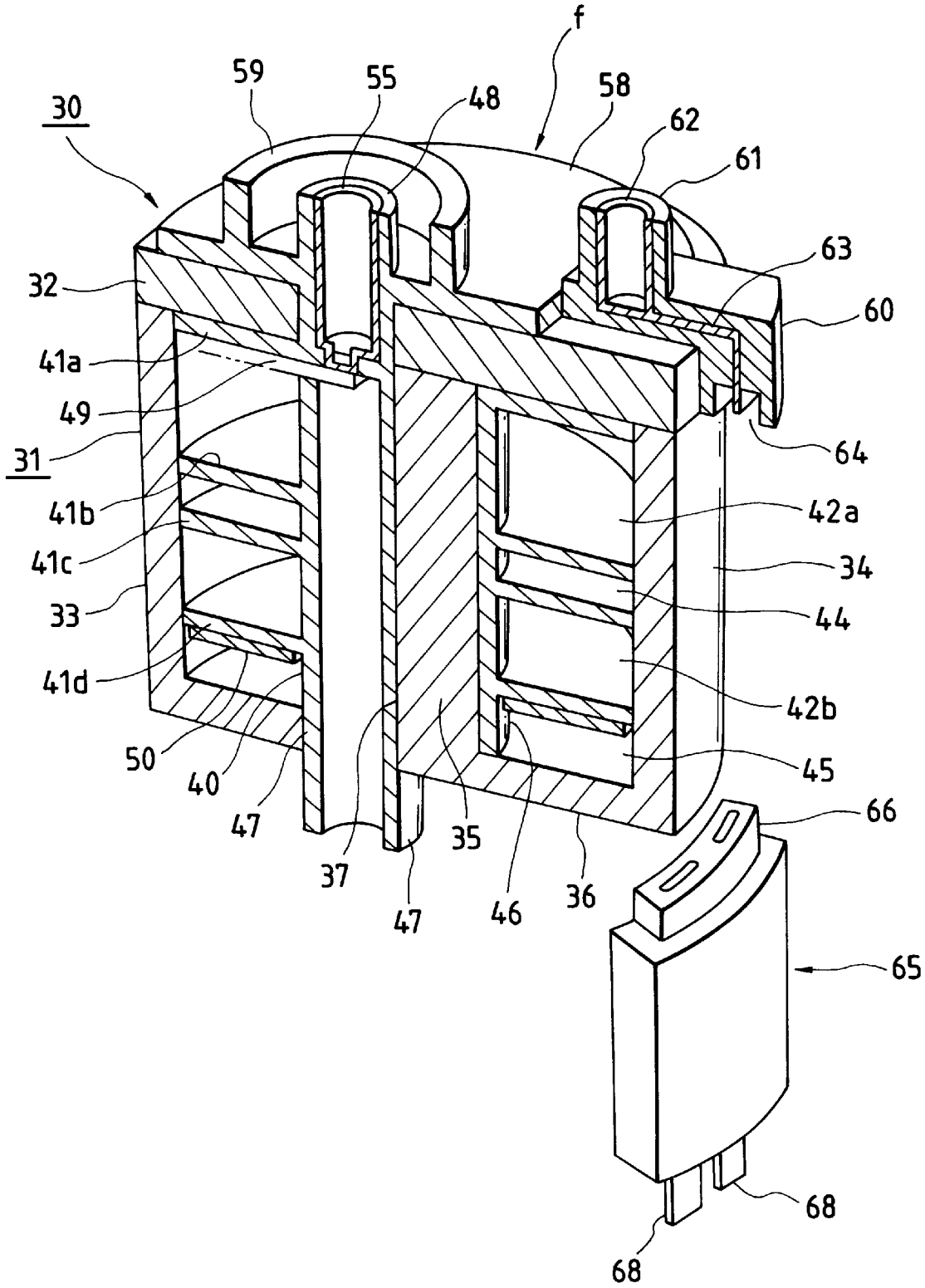
FIG. 8 is a longitudinal sectional view in perspective of a lighting-on transformer in which a part of a secondary coil is illustrated.

Reference is made to FIG. 8. The coil bobbin 40 is made of synthetic resin. As shown, the coil bobbin 40 includes a cylindrical bobbin base 46 to be put into close contact with the outer surface of the iron core 35. A plural number of flange-like plates 41*a* to 41*d* are extended radially and outwardly from the outer surface of the cylindrical bobbin base 46. The flange-like plates 41*a* to 41*d* and the cylindrical wall 34 of the core block 33 define spaces 42*a* and 42*b*, an intermediate space 44 located between the spaces 42*a* and 42*b*, and another space 45. A secondary coil 49 is successively wound in the spaces 42*a* and 42*b* through the intermediate space 44, and a primary coil 50 like a thin film is put in the space 45.

Figure 10:
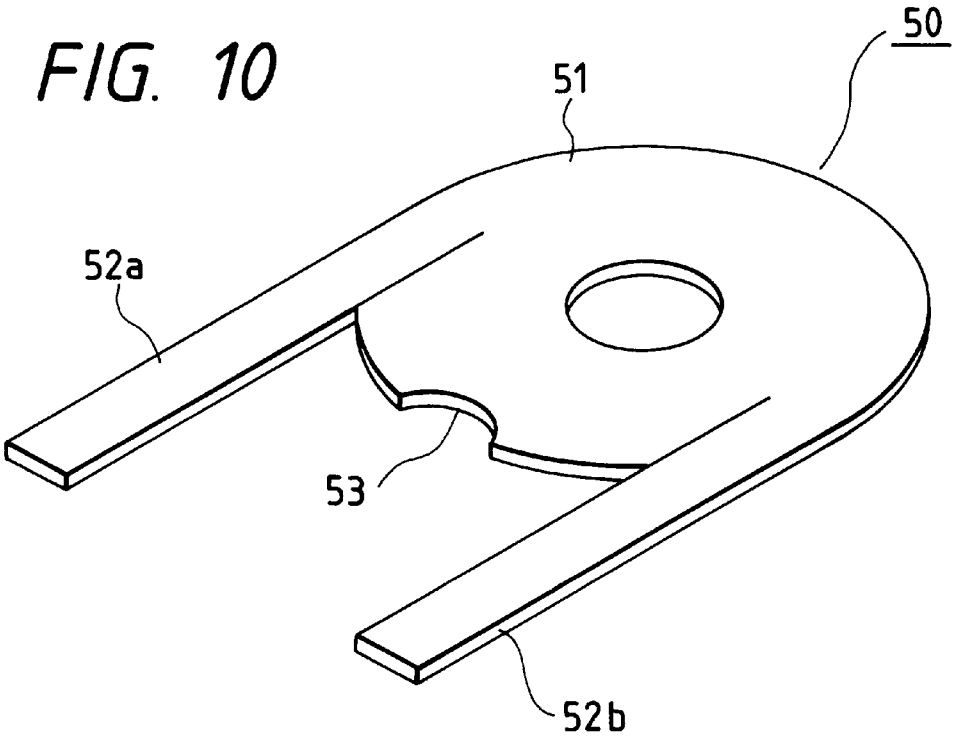
FIG. 10 is a perspective view showing a primary coil.

The primary coil 50 is best illustrated in FIG. 10. As shown, the primary coil 50 is formed of a ring-like thin film 51 and a couple of connection pieces 52*a* and 52*b* tangentially extended from both sides of the ring-like thin film 51.

However, the shape of the primary coil 50 is not limited to this shape. When the core block 32 is coupled with the core block 33 (to be described in detail later), the primary coil 50 is put in the space 45 and the connection pieces 52*a* and 52*b* of the primary coil 50 are passed through a couple of insertion holes 38 (only one hole 38 is illustrated in FIG. 9) and lead outside out of the core housing 31. As shown, the insertion holes 38 are formed in the rear wall 36 of the core block 33.

The coil bobbin 40 includes the cylindrical connection part 47 which is deviated from the center thereof. The cylindrical connection part 47 contacts the inner wall of the through-hole 37 of the iron core 35 when inserted in the through-hole 37. The inner space of the cylindrical connection part 47 is used for spot welding in wiring work to be described later. The rear end of the cylindrical connection part 47 protrudes from the rear end of the coil bobbin 40 and is attached to the printed circuit board 90.

Another cylindrical connection part 48 protrudes from the front side of the coil bobbin 40 and is concentric with the cylindrical connection part 47 of the coil bobbin 40. A high-voltage side connecting piece 55 is fit into the cylindrical connection part 48, as shown in FIG. 11. The winding-start terminal 49*a* of the secondary coil 49 is inserted into the cylindrical connection part 47 through its insertion opening, passing through the through-hole of the partitioning wall located between the cylindrical connection parts 47 and 48, and is brought into contact with the face of a seat for the high-voltage side connecting piece 55. Within the cylindrical connection part 47, the terminal 49*a* of the secondary coil 49 is spot welded to the seat face. The secondary coil 49 is successively wound in the spaces 42*a* and 42*b* through the intermediate space 44.

A shielding member 58, which is physically continuous to the coil bobbin 40, is formed on the front end of the core block 32, while covering a part of the side of the core block 32. However, the shielding member 58 can be formed of either the same material or a different material as the coil bobbin 40. The front side of the shielding member 58 serves as an insulating shield surface f. The cylindrical connection part 48 protrudes outward from the insulating shield surface f. A cylindrical portion 59 is formed around and is concentric with the cylindrical connection part 48. A couple of cylindrical portions 61 located to correspond with the couple of low-voltage terminals 13 of the socket 10. Low-voltage side connecting pieces 62 are fit into the cylindrical portions 61. The cylindrical portions 61 include extended portions 60 that are L shaped in cross section and formed integral therewith. Earthing (grounding) paths 63 connecting to the low-voltage side connecting pieces 62 are provided inside the extended portions 60, respectively (in FIG. 8, only one of them is illustrated). Each extended portion 60 extends over the side of the core block 32, so that an opening 64 is formed between the tip of the extended portion 60 and the part of the shielding member 58 partly covering the side of the core block 32. The earthing path 63, which is located between the outer surface of the shielding member 58 partly covering the side of the core block 32 and the inner surface of the extended portions 60, is exposed at the end opening 64, whereby it is ready for an electrical contact with a low-voltage or grounding path (earthing path) on the printed circuit board 90. A connection part 65 constructed as shown in FIG. 8 is used for the electrical connection. As shown, the connection part 65 has a coupling part 66 protruding forward and a couple of terminals 68 extending rearward. In use, the coupling part 66 of the connection part 65 is inserted into the end opening 64, and the terminals 68 of the connection part 65 are inserted into through-holes (not shown) of the printed circuit board 90, whereby a low-voltage connection (earthing or grounding) is set up.

A high-voltage side terminal 70 is fit into the cylindrical connection part 48. The high-voltage side terminal 70 is connected to the high-voltage connecting piece 55. The high-voltage side terminal 70 consists of a single metal sheet. The metal sheet is bent and wound to form a connection surface of a double structure so as to receive the bifurcated high-voltage terminal 12 planted in the resin socket 10, thereby securing an electrical connection.

A low-voltage side terminal 71 is fit into each of the cylindrical portions 61 to connect to the low-voltage side connecting pieces 62. The low-voltage side terminal 71 also consists of a single metal sheet, which is shaped so as to receive the low-voltage terminals 13 also planted in the socket 10, thereby securing an electrical connection.

The high-voltage side terminal 70 and the low-voltage side terminal 71 may be constructed into the coil bobbin 40, if required. The high-voltage side connecting piece 55 and the low-voltage side connecting pieces 62 may be included in the high- and low-voltage side terminals.

Figure 12:
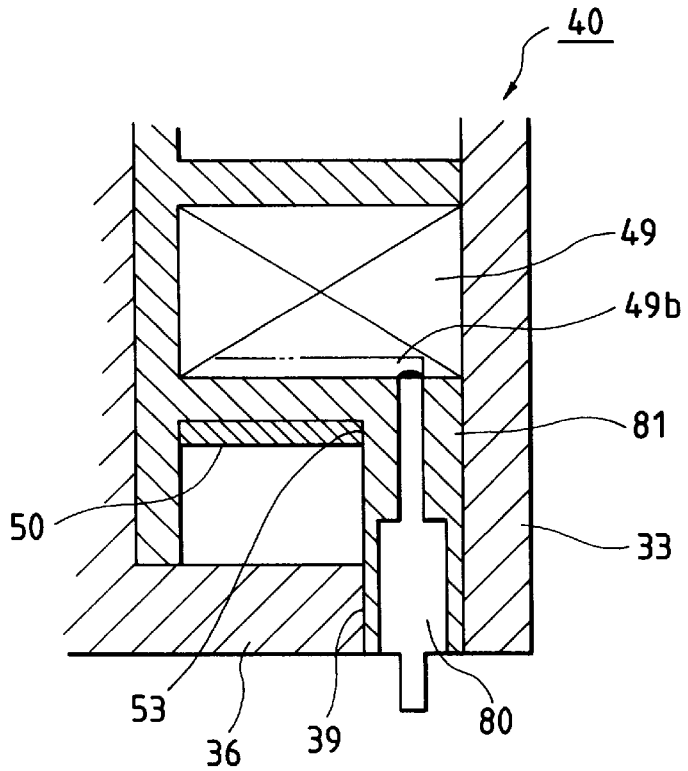
FIG. 12 is a sectional view showing a part of the lighting-on transformer including the connection of the low-voltage terminal of the secondary coil.
Figure 13:
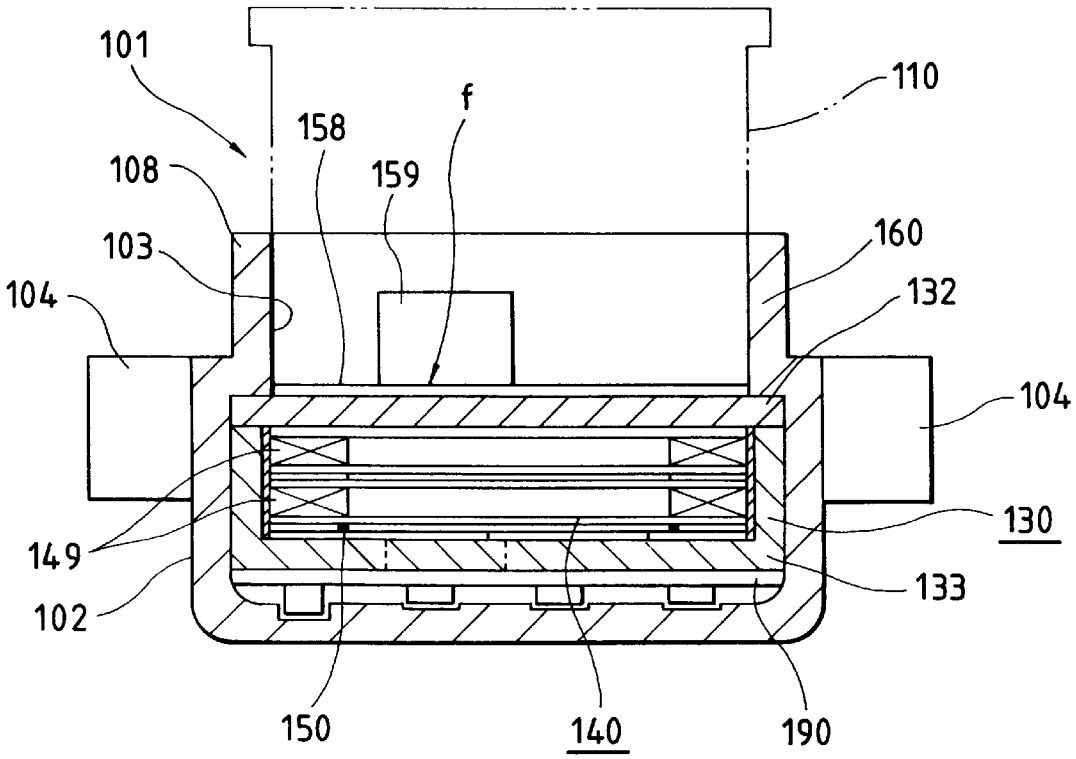
FIG. 13 is a longitudinal sectional view showing a vehicle- lamp lighting-on device which is a second embodiment of the present invention.
Figure 14:
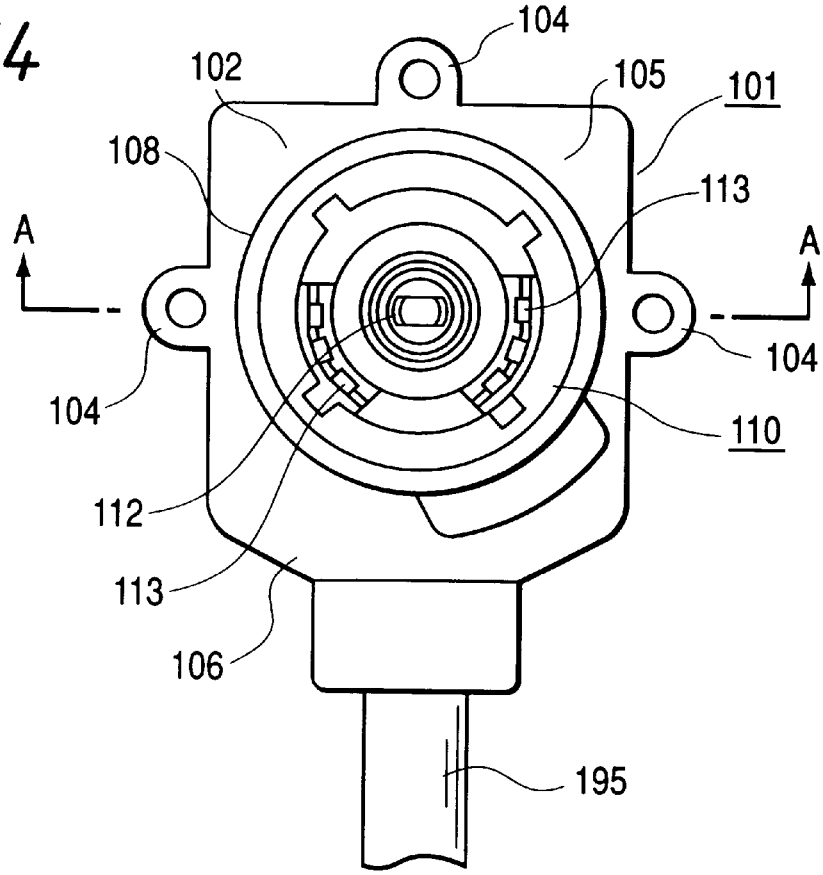
FIG. 14 is a plan view showing the vehicle-lamp lighting-on device.
Figure 15:
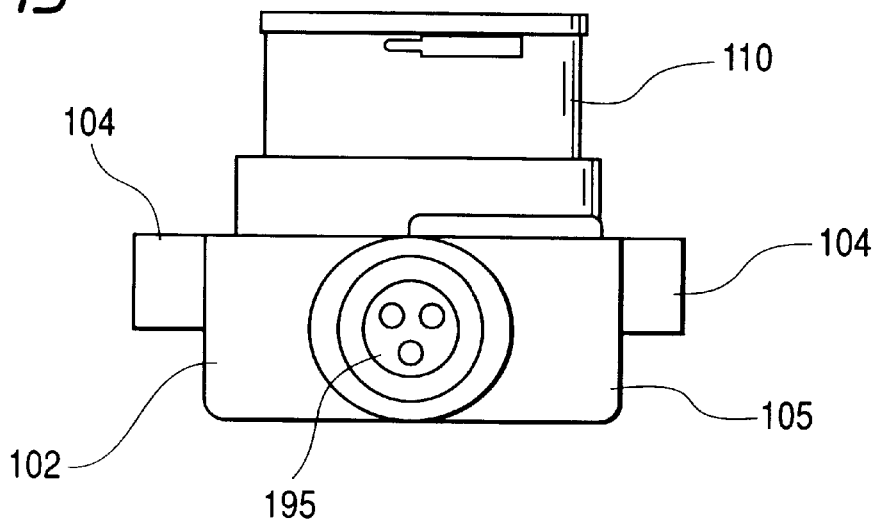
FIG. 15 is a side view showing the vehicle-lamp lighting-on device.

The winding end terminal 49*b* (as a low-voltage terminal) of the secondary coil 49, as shown in FIG. 12, is led out of the core housing 31 by way of a connection terminal 80, and electrically connected to the low-voltage path of the printed circuit board 90. The connection terminal 80 is put in a protecting protruded part 81, and the winding and terminal 49*b* is bonded to the inner end of the connection terminal 80 by spot welding. The protecting protruded part 81 passes through a space 53 for the primary coil 50 and a through-hole 39 formed in the rear wall 36 of the core block 33.

A manufacturing procedure of the lighting-on transformer 30 will be described. The structure of the core block 32 and the coil bobbin 40 is manufactured by injection molding. The secondary coil 49 is put on the coil bobbin 40. The terminal 49*a* of the secondary coil 49 is spot welded to the high-voltage side connecting piece 55, within the cylindrical connection part 47. The secondary coil 49 is successively wound in the spaces 42*a* and 42*b* through the intermediate space 44. The winding end terminal 49*b* of the secondary coil 49 is spot welded to the inner end of the connection terminal 80. The primary coil 50 is put in the space. The core block 33 is applied toward the rear side of the coil bobbin 40. Thereafter, if necessary, the transformer structure thus constructed is impregnated with sealing resin. In this way, the lighting-on transformer 30 is completed.

Since the lighting-on transformer 30 is covered with the core housing 31, the resultant structure is a neat, single structure. With provision of the extended portion 6, it is easy to form an orderly mounting space 92 within the body case 2. The coil bobbin 40 with the shielding member 58 continuous thereto is injection molded onto the core block 32 of the core housing 31, to thereby form a single unit. The result is that the number of the required component parts is reduced, and the lighting-on transformer may readily be assembled by merely fitting the core block 33 to the counter core block 32.

Thereafter, the lighting-on transformer 30 thus assembled is mounted in the body case 2; required electrical connections are made; the connection opening 3 is covered with the insulating shield surface f; the resin socket 10 is fit to the connection opening 3; the high-voltage terminal 12 is connected to the high-voltage side terminal 70 supported on the insulating shield surface f (FIG. 11); and the low-voltage terminals 13 are connected to the low-voltage side terminals 71 also supported on the insulating shield surface f; whereby a vehicle-lamp lighting-on device 1 is completed.

In operation, the lead wire 95 is connected to given circuits on the printed circuit board 90; a primary voltage of approximately 400V is applied to the primary coil 50 through the circuits; the primary voltage is boosted to 13 kV or higher by the secondary coil 49; and the boosted secondary voltage is applied to the high-voltage side terminal 70 and to the high-voltage terminal 12.

The thus constructed vehicle-lamp lighting-on device 1 is attached to the front of the engine compartment of a vehicle; a discharge lamp, e.g., a metal halide lamp, is attached to the socket 10; the low-voltage terminals 13 are connected to the peripheral electrodes of the discharge lamp; the high-voltage terminal 12 is connected to the center electrode; and high voltage of about 13 kV is applied to the discharge lamp to light the lamp.

In the vehicle-lamp lighting-on device 1, the insulating shield surface f of the insulating shielding member 58 of the lighting-on transformer 30 is included in the connection opening 3 of the body case 2. The high-voltage side terminal 70 and the low-voltage side terminals 71 are exposed in the connection opening 3. Therefore, the vehicle-lamp lighting-on device 1 can be completed by merely attaching the socket 10 to the assembly of the lighting-on transformer 30 and the body case 2. Therefore, assembly of the device is easy, and the height of the vehicle-lamp lighting-on device is reduced overall since there is no need to form a wall corresponding to the shielding member 58 in the body case 2.

Since the shielding member 58 is disposed in the front of the core housing 31, a distance from the high-voltage side terminal 70 to the secondary coil 49 through the surface of the coil bobbin 40 is increased. Because of this, there is little chance that shortcircuiting will occur. Provision of the cylindrical portion 59 further elongates the surface distance.

As seen from the foregoing description, in the vehicle-lamp lighting-on device 1, a body case 2 includes a connection opening 3 formed in the front end thereof. A lighting-on transformer 30 is disposed within the body case 2. The transformer 30 includes a core housing 31 with an iron core 35 and a coil bobbin 40 with a secondary coil 49 wound thereon. The connection opening 3 of the body case 2 is shielded at the front end of the lighting-on transformer 30. A socket 10 for receiving a vehicle discharge lamp includes a high-voltage terminal 12 and low-voltage terminals 13. When the socket 10 is inserted into the connection opening 3 of the body case 2, the high-voltage terminal 12 of the socket 10 is connected to the high-voltage side terminal 70 of the lighting-on transformer 30, and the low-voltage terminals 13 are connected to the low-voltage side terminals 71.

The vehicle-lamp lighting-on device 1 thus constructed has the following advantages:

Since the lighting-on transformer 30 is covered with the core housing 31, it has a neat, single structure. An orderly mounting space 92 is formed within the body case 2. Therefore, the resultant vehicle-lamp lighting-on device 1 is simple and compact.

The connection opening 3 of the body case 2 is closed by the shield surface f of the lighting-on transformer 30, the surface being made of insulating material, and the high-voltage side terminal 70 and the low-voltage side terminals 71 are exposed in the connection opening 3. The vehicle-lamp lighting-on device 1 can be completed by merely attaching the socket 10 to the assembly of the lighting-on transformer and the body case. Therefore, assembly of the device is easy.

The height of the vehicle-lamp lighting-on device is reduced overall since there is no need to form a wall corresponding to the insulating shield surface f (shielding member 58) in the body case 2.

Since the insulating shield surface f is disposed in the front of the core housing 31, a surface distance ranging from the high-voltage side terminal 70 to the secondary coil 49 through the surface of the coil bobbin 40 is elongated. Because of this, there is little chance that shortcircuiting will occur.

Second Embodiment

A vehicle-lamp lighting-on device 101 which is a second embodiment of the present embodiment will be described with reference to the accompanying drawings.

The vehicle-lamp lighting-on device 101, as shown in FIGS. 13 through 16, is generally made up of a body case 102, a socket 110 and a lighting-on transformer 130, and the like. The body case 102 and the socket 110 are both made of synthetic resin.

Figure 16:
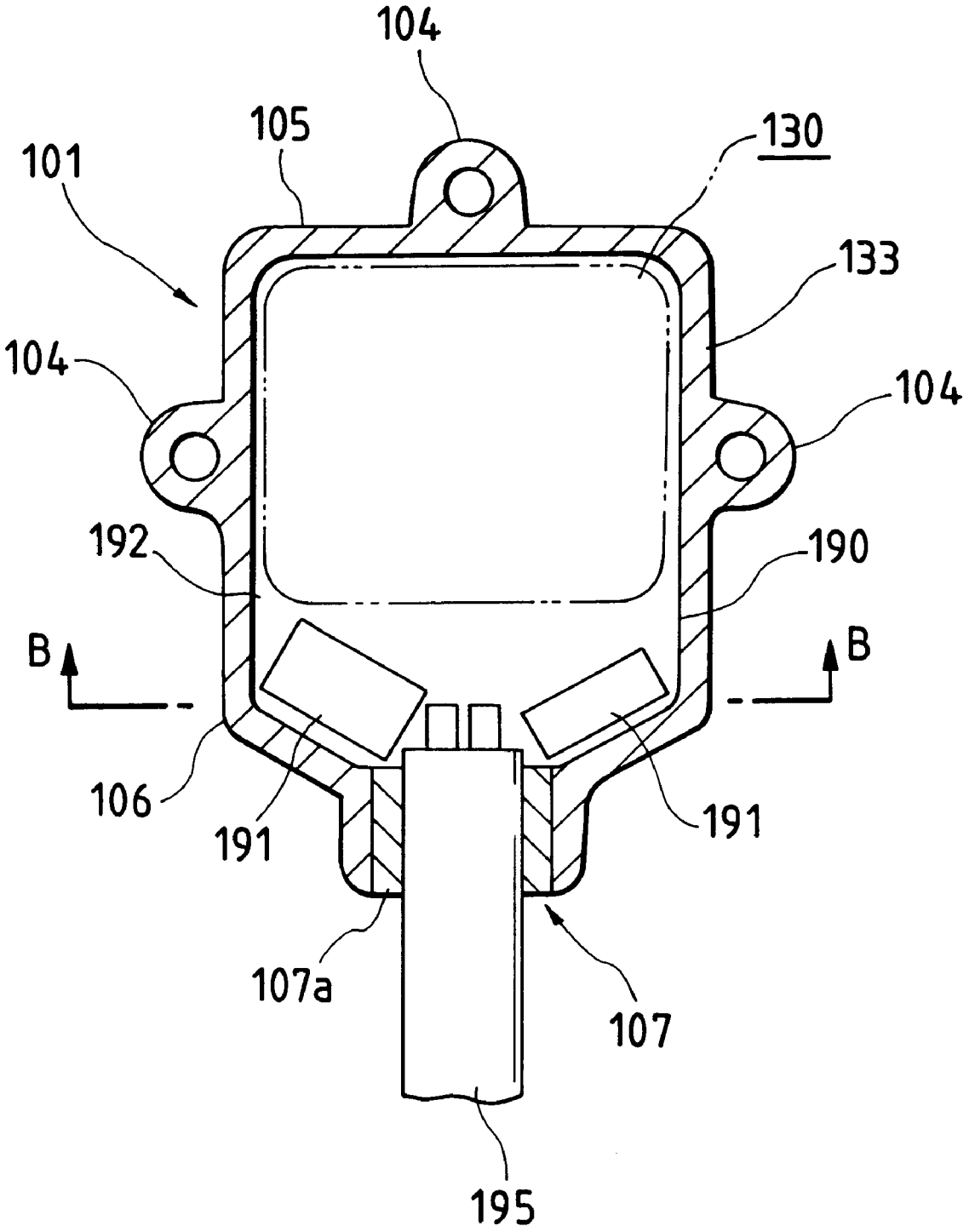
FIG. 16 is a transverse sectional view showing the vehicle lamp lighting-on device when a socket is removed.

As shown, the synthetic resin body case 102 includes a circular portion 105 and an extended portion 106 extended outwardly of the circular portion 105. The front end of the circular portion 105 is opened to provide a circular connection opening 103 defined by a ring-like circumferential wall 108. A plural number of mounting portions 104 protrude outward from the circumferential outer surface of the circular portion 105 of the body case 102. The extended portion 106 is generally U-shaped when viewed from above. A cylindrical protrusion, which has a through-hole 107 longitudinally formed therein, protrudes outward from the central part of the bottom of the U-shape of the extended portion 106 (FIG. 16). A lead wire (shield cable) 195 is lead out through the through-hole 107 of the cylindrical portion. Within the through-hole 107, a sealing member 107*a*, e.g., a seal ring or sealing rubber tube, is inserted between the lead wire 195 and the inner wall of the through-hole 107, whereby the through-hole 107 having the lead wire 195 inserted thereinto is sealed. A printed circuit board 190 is placed on the bottom surface of the body case 102. A space 192 is formed in the extended portion 106 of the body case 102. The space is used for mounting a circuit component 191, e.g., a condenser, on the printed circuit board 190 (FIG. 16). A specific example of the body case 102, actually designed, was 18.6 mm in height and included a circular portion of the connection opening 103 with an inside diameter of 36 mm.

The socket 110 is inserted into the connection opening 103 of the circular portion 105 of the body case 102. The socket 110, cylindrical in shape, includes a high-voltage terminal 112 located at the central part thereof and a couple of low-voltage terminals 113, which are located around and spaced from the high-voltage terminal 112 with the bifurcated ends.

A construction of the lighting-on transformer 130 will be described with reference to FIGS. 17 through 20.

The lighting-on transformer 130 is constructed such that a coil bobbin 140 is placed in a core housing 131 having an iron core 135.

The core housing 131 is made of magnetic material, e.g., ferrite. A couple of core blocks 132 and 133 are coupled together into a cubic block whose corner are rounded, forming a core housing 131. A specific example of the cubic block is 11.4 mm in height and 36 mm in width. It is not necessary that the corners are rounded, and the core housing 131 can be columnar.

Figure 18A:
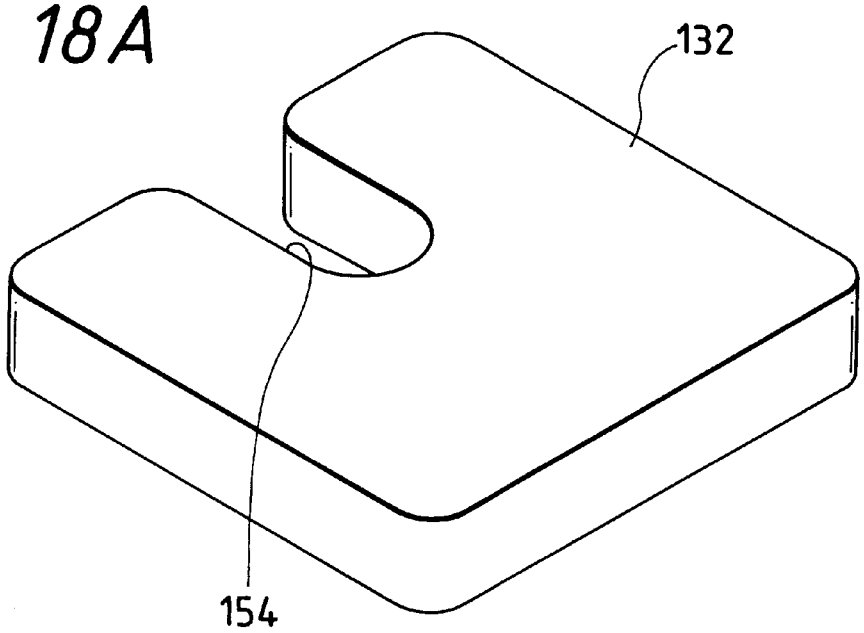
FIGS. 18A and 18B are perspective views showing a plate-like core block and a tubular core block, respectively, which are combined into a core housing.

The core block 132 of the core housing 131, as shown in FIG. 18A, is a plate, substantially square, having a thickness of about 2 mm. An elongated cutout 154 is formed in one of the sides of the square plate. The bottom of the cutout 154 is tailored in shape and position to a cylindrical connection part 148 (to be described later).

Figure 17:
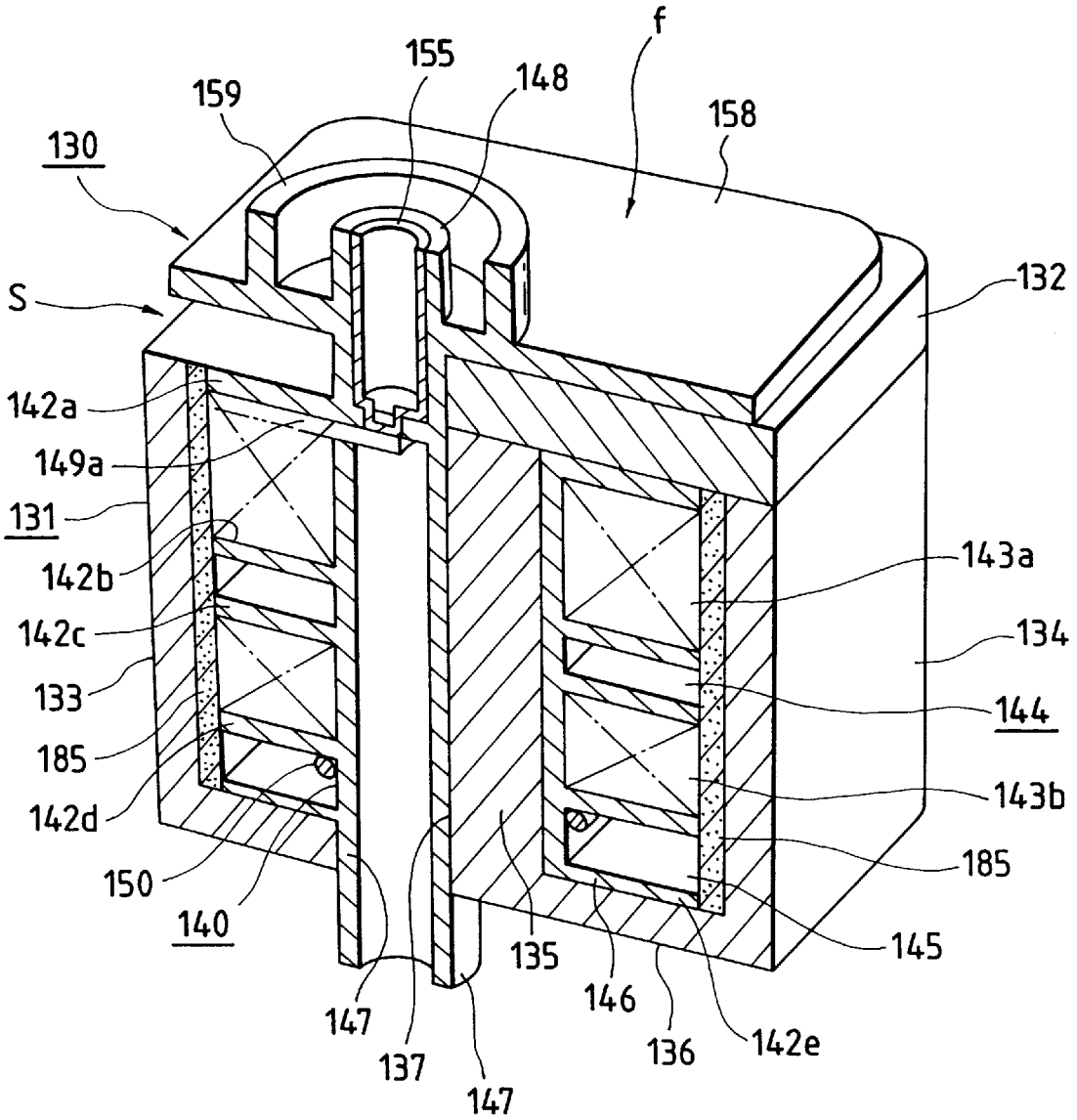
FIG. 17 is a longitudinal sectional view in perspective of a lighting-on transformer, the illustration showing a part of a secondary coil.
Figure 18B:
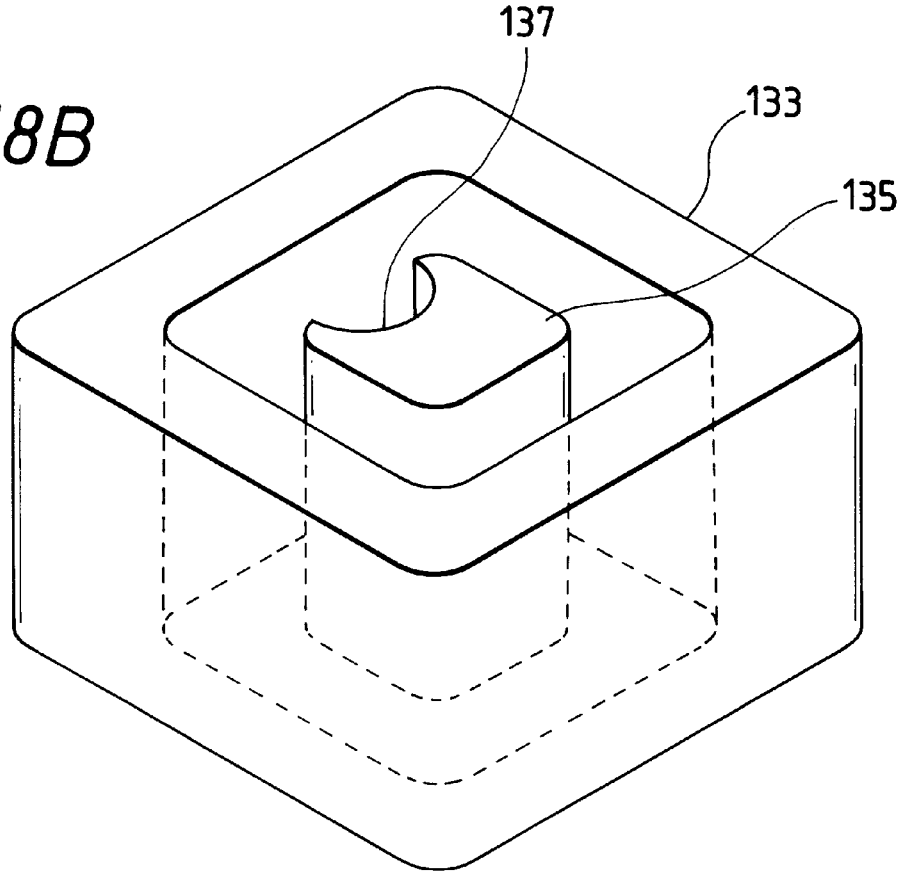

The detail of the core block 133 of the core housing 131 is illustrated in FIGS. 17 and 18B. As shown, the core block 133 includes a cylindrical wall 134, an iron core 135 and a rear wall 136 which interconnects the cylindrical wall 134 and the iron core 135. The cylindrical wall 134, tubular, is square in cross section and the corners are rounded, like the core block 132. The cylindrical wall 134 is raised vertically from the outer circumferential edge of the rear wall 136. The iron core 135 is raised vertically from the central part of the core block 133. A through-hole 137 is extended passing through the iron core 135 in its lengthwise direction while being located slightly deviated from the center of the core block 133. A cylindrical connection part 147 of the coil bobbin 140 (which will be described later) is inserted into the through-hole 137. The core block 133 is manufactured as a single component part, and, in assembling, is applied to the rear side of the unit structure including the core block 132 and the coil bobbin 140 (will be described later). While the core blocks 132 and 133 are square in cross section and their corners are rounded, these blocks may be circular in cross section. For example, the core block 132 is configured like a cylindrical disc, and the core block 133 is configured like a cylindrical tube. The core blocks 132 and 133 are coupled together into a cylindrical block.

A construction of the coil bobbin 140 to be integrated with the core block 132 will be described.

Reference is made to FIG. 17. The coil bobbin 140 is made of synthetic resin. The coil bobbin may be made of synthetic resin such as LCP, PPE, PBT, polyimide and polyamide, rubber material, ceramic material such as alumina, mica, silica, $Si_3N_4$, and the like. As shown, the coil bobbin 140 includes a tubular bobbin base 146 to be put into close contact with the outer surface of the iron core 135. A plural number of flange-like plates 142*a* to 142*e* are extended radially and outwardly from the outer surface of the tubular bobbin base 146. The flange-like plates 142*a* to 142*d* and the cylindrical wall 134 of the core block 133 define spaces 143*a* and 143*b*, an intermediate space 144 located between the spaces 143*a* and 143*b*, and another space 145, whereby to form a bobbin main portion such that the entire bobbin main portion is located below a distance s (insertion gap). A secondary coil 149 is successively wound in the spaces 143*a* and 143*b* and on the intermediate space 144, and a primary coil 150 is put in the space 145.

The coil bobbin 140 includes the cylindrical connection part 147 which is deviated from the center thereof. The cylindrical connection part 147 is put in contact with the inner wall of the through-hole 137 of the iron core 135. The rear end of the cylindrical connection part 147 protrudes from the rear end of the coil bobbin 140 and attaches to the printed circuit board 190.

Another cylindrical connection part 148 protrudes from the front side of the coil bobbin 140 and is concentric with the cylindrical connection part 147 of the coil bobbin 140. A front end plate 158 is supported by the cylindrical connection part 148 and extends parallel to and spaced from the front end surface of the bobbin main portion by a short distance s. The short distance s is equal to the thickness of the plate-like core block 132.

The front side of the front end plate 158 serves as an insulating shield surface f for shielding the connection opening 103, which will be described later. The cylindrical connection part 148 is raised above the front side of the front end plate 158, and opened at the top thereof. A cylindrical portion 159 is formed around and is concentric with the cylindrical connection part 148.

Figure 19:
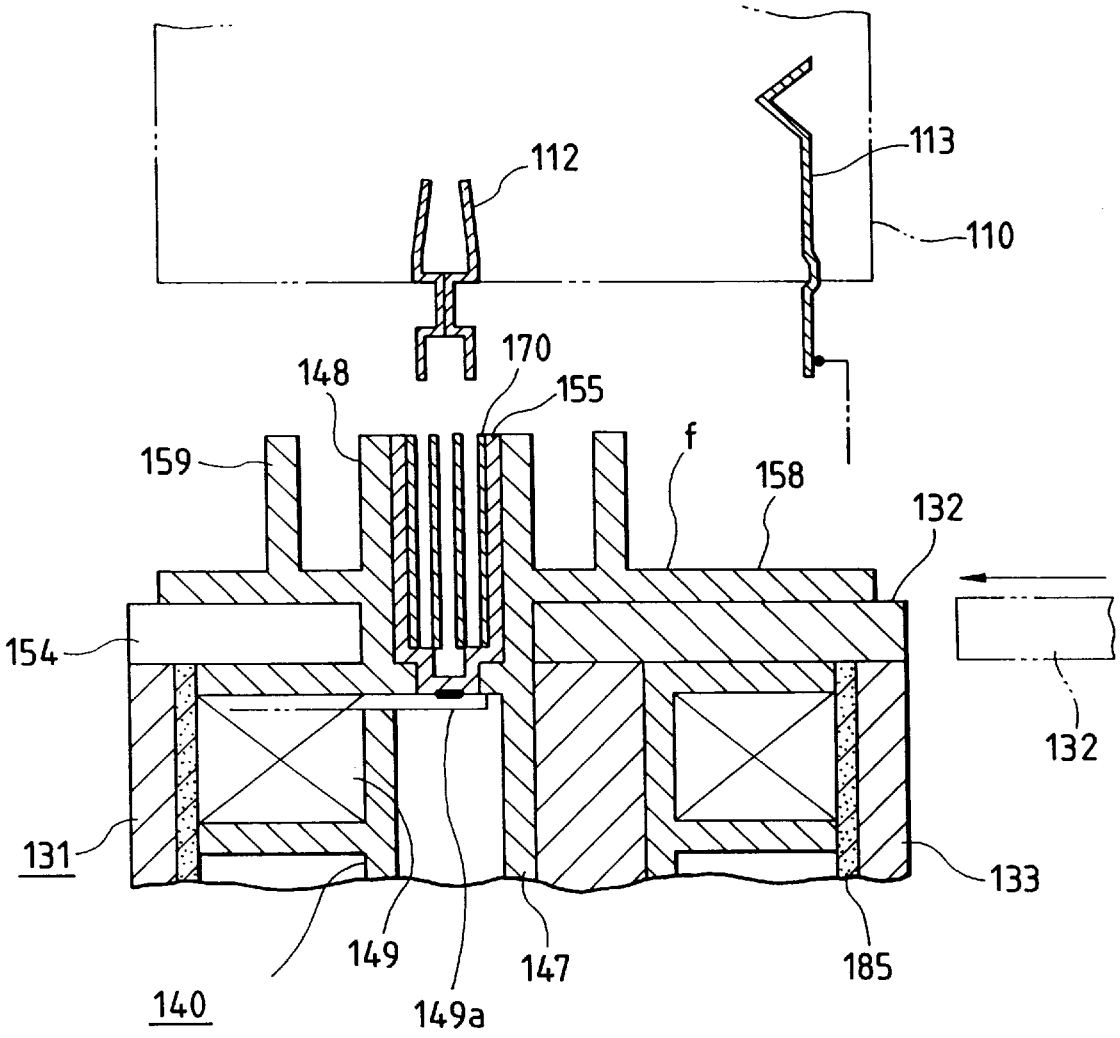
FIG. 19 is a cross sectional view showing the socket connected to the lighting-on transformer.
Figure 20:
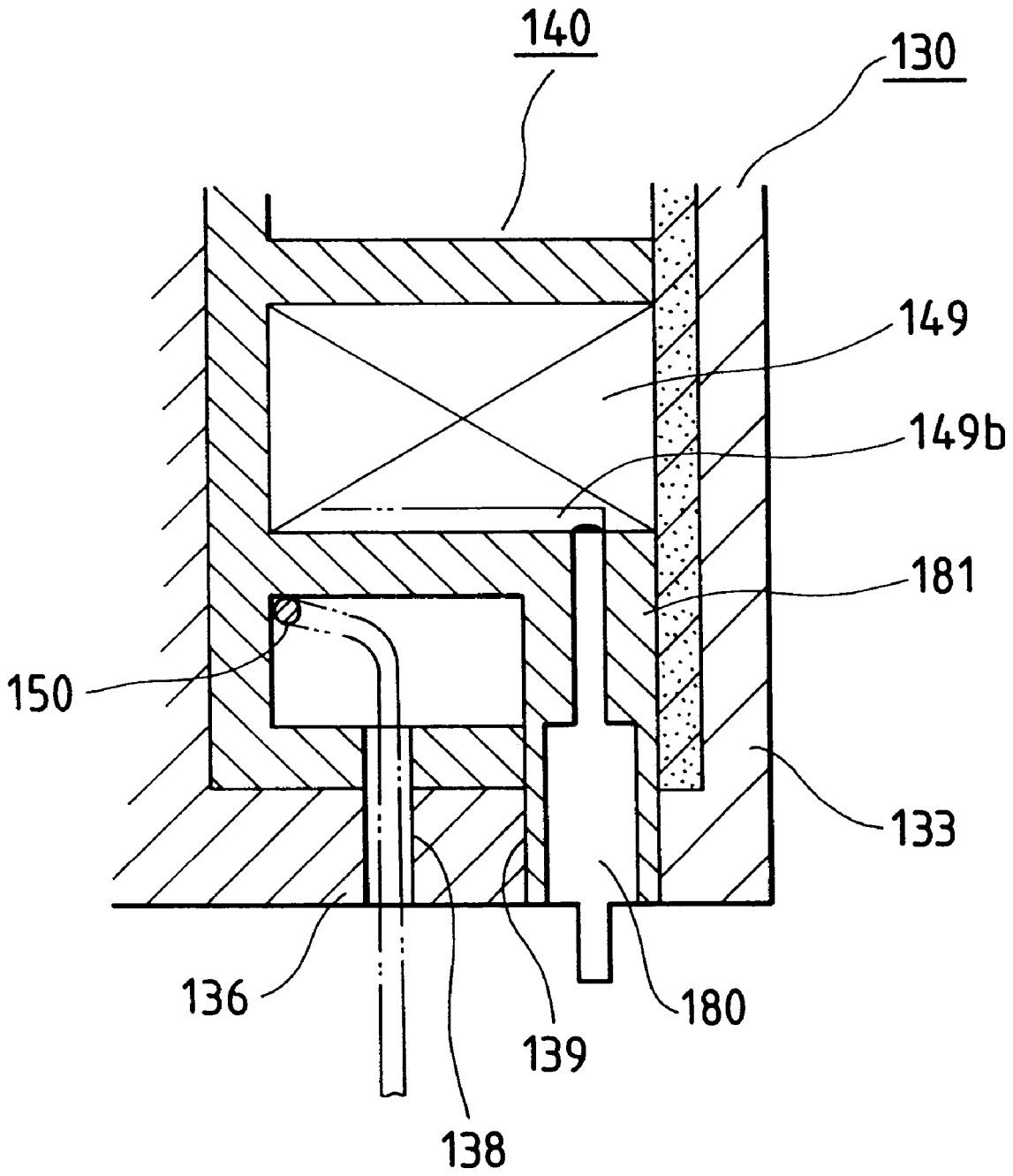
FIG. 20 is a sectional view showing a part of the lighting-on transformer, the illustration showing the connection of the low-voltage terminal of the secondary coil.

As shown in FIG. 19, the plate-like core block 132 is horizontally inserted into the gap defined by the distance s between the front end plate 158 and the front end surface of the bobbin main portion. The cylindrical connection part 148 is positioned within the cutout 154, while traversing the gap denoted as s.

A high-voltage side connecting piece 155 is inserted into the cylindrical connection part 148 through the opening thereof (FIG. 19). The winding-start terminal 149*a* of the secondary coil 149 is inserted into the cylindrical connection part 147 through its insertion opening, passing through the through-hole of the partitioning wall located between the cylindrical connection parts 147 and 148, and is brought into contact with the face of a seat for the high-voltage side connecting piece 155. Within the cylindrical connection part 147, the terminal 149*a* of the secondary coil 149 is spot welded to the seat face.

A high-voltage side terminal 170 is fit into the cylindrical connection part 148. The high-voltage side terminal 170 is connected to the high-voltage side connecting piece 155. The high-voltage side terminal 170 consists of a single metal sheet. The metal sheet is bent and wound to form a connection surface of a double structure so as to receive the bifurcated high-voltage terminal 112 planted in the resin socket 110, thereby securing an electrical connection.

In the construction of the coil bobbin 140, as described above, the plate-like core block 132 is horizontally inserted into the gap s between the front end plate 158 and the front end surface of the bobbin main portion, whereby the core block 132 and the bobbin main portion form a unit structure. Then, the winding-start terminal 149*a* of the secondary coil 149 is spot welded to the high-voltage side connecting piece 155, and the secondary coil 149 is successively wound in the spaces 143*a* and 143*b* through the intermediate space 144. The winding end terminal (low-voltage voltage terminal) 149*b* of the secondary coil 149 is spot welded to a connection terminal 180 contained in a protecting protruded part 181, which is continuous to the lower part of the bobbin main portion 141. And the primary coil 150 is wound in the space 145 of the bobbin main portion 141.

Following the winding of the secondary coils 149, an insulating layer 185, e.g., an insulating tape, is wound around the bobbin main portion, and the tubular core block 133 is mated with the coil bobbin 140 from its rear side. Before the application of the core block 133, both ends of the primary coil 150 are pulled out through insertion holes 138 (FIG. 20) of the bottom of the core block 133. The iron core 135 of the core block 133 is inserted into the inner part of the cylindrical bobbin base 146, to complete an assembly of the lighting-on transformer 130. In the assembly, the flange-like plate 142*e* of the bobbin main portion sits on the inner bottom surface of the core block 133, to create a sealing function. Thereafter, the inner part of the core housing 131 is impregnated with sealing resin, if necessary.

Here, the assembly of lighting-on transformer 130 is completed. As described above, the lighting-on transformer 130 is assembled by applying the tubular core block 132 and the tubular core block 133 to the coil bobbin 140. This makes it easy to assemble the lighting-on transformer 130. Further, since the lighting-on transformer 130 is covered with the core housing 131, the resultant structure is a neat, single structure. With provision of the extended portion 106, it is easy to form an orderly mounting space 192 within the body case 102.

Thereafter, the lighting-on transformer 130 thus assembled is mounted in the body case 102; required electrical connections are made; the connection opening 103 is covered with the insulating shield surface f; the resin socket 110 is fit to the connection opening 103; the high-voltage terminal 112 is connected to the high-voltage side terminal 170 supported on the insulating shield surface f (FIG. 19); and the low-voltage terminals 113 are connected to the low-voltage voltage path on the printed circuit board by means of lead wires, for example; whereby a vehicle-lamp lighting-on device 101 is completed.

In operation, voltage on the lead wire 195 is connected to given circuits on the printed circuit board 190; a primary voltage of approximately 400V is applied to the primary coil 150 through the circuits; the primary voltage is boosted to 13 kV or higher by the secondary coil 149; and the boosted secondary voltage is applied to the high-voltage side terminal 170 and to the high-voltage terminal 112.

The thus constructed vehicle-lamp lighting-on device 101 is attached to the front of the engine compartment of a vehicle; a discharge lamp, e.g., a metal halide lamp, is attached to the socket 110; the low-voltage terminals 113 are connected to the peripheral electrodes of the discharge lamp; the high-voltage terminal 112 is connected to the center electrode; and high voltage of about 13 kV is applied to the discharge lamp to light the lamp.

In the vehicle-lamp lighting-on device 101, the insulating shield surface f of the insulating shielding member 158 of the lighting-on transformer 130 is installed in the connection opening 103 of the body case 102. Because of this, a surface distance ranging from the high-voltage side terminal 170 to the secondary coil 149 through the upper and lower surfaces of the coil bobbin 140 is increased, and hence, there is little chance for shortcircuiting to occur. Use of the cylindrical portion 159 further elongates the surface distance.

As seen from the foregoing description, in a lighting-on transformer 130 of the vehicle-lamp lighting-on device 101, in the front end of the coil bobbin 140, a front end plate 158 is spaced upward from the front end surface of the bobbin main portion 141 wound by the secondary coil 149 by a short distance s, thereby forming a gap between the front end plate and the front end surface of the bobbin main portion. The core housing 131 is formed with a plate-like core block 132 being equal in thickness to the gap, and a tubular core block 133 including a cylindrical wall 134, the iron core 135 and a rear wall 136 which interconnects the cylindrical wall 134 and the iron core 135. The plate-like core block 132 is horizontally inserted into the gap between the front end plate 158 and the front end surface of the bobbin main portion 141, and the tubular core block 133 is applied to the bobbin main portion. The vehicle-lamp lighting-on device 101 thus constructed has the following advantages:

The lighting-on transformer is constructed in a simple manner where the plate-like core block 132 is inserted into the gap s in the front end of the coil bobbin 140 and the tubular core block 133 is applied to the bobbin main portion. Therefore, assembly of the lighting-on transformer is easy.

Since the lighting-on transformer 130 is covered with the core housing 131, it has a neat, single structure. An orderly mounting space 192 is formed within the body case 102. Therefore, the layout design is easy, and the resultant vehicle-lamp lighting-on device 101 is simple and compact.

The height of the vehicle-lamp lighting-on device is reduced as a whole since there is no need to form a wall corresponding to the shielding member 158 in the body case 102.

Since the front end plate 158 is disposed in the front of the core housing 131, a surface distance ranging from the high-voltage side terminal 170 to the secondary coil 149 through the surface of the coil bobbin 140 is increased. Because of this, there is little chance that shortcircuiting will occur.

Third Embodiment

Figure 21:
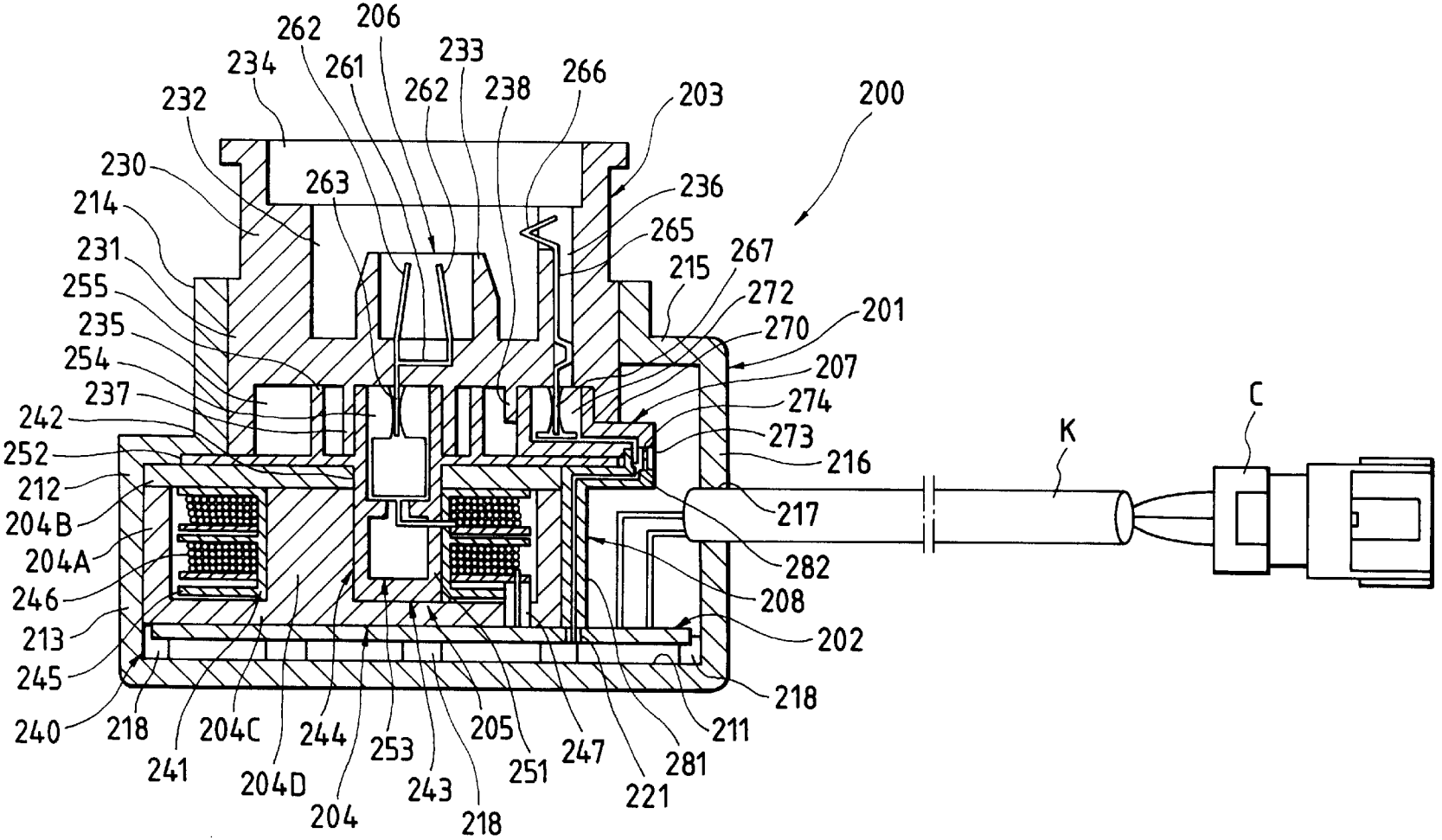
FIG. 21 is a cross sectional view showing a vehicle-lamp lighting-on device according to a third embodiment of the present invention.
Figure 22:
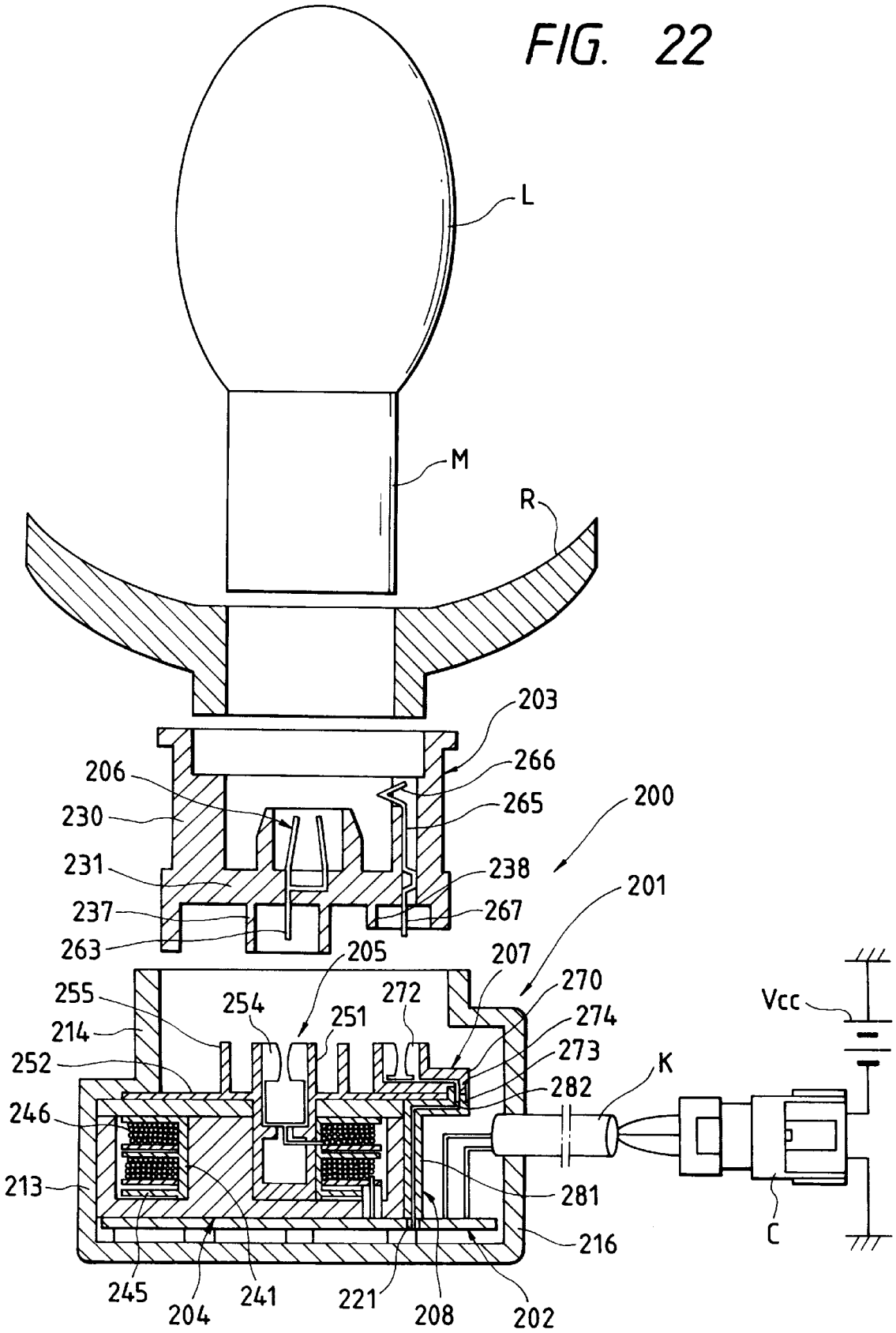
FIG. 22 is a cross sectional view showing the vehicle-lamp lighting-on device when a socket is separated from a housing.
Figure 23A:
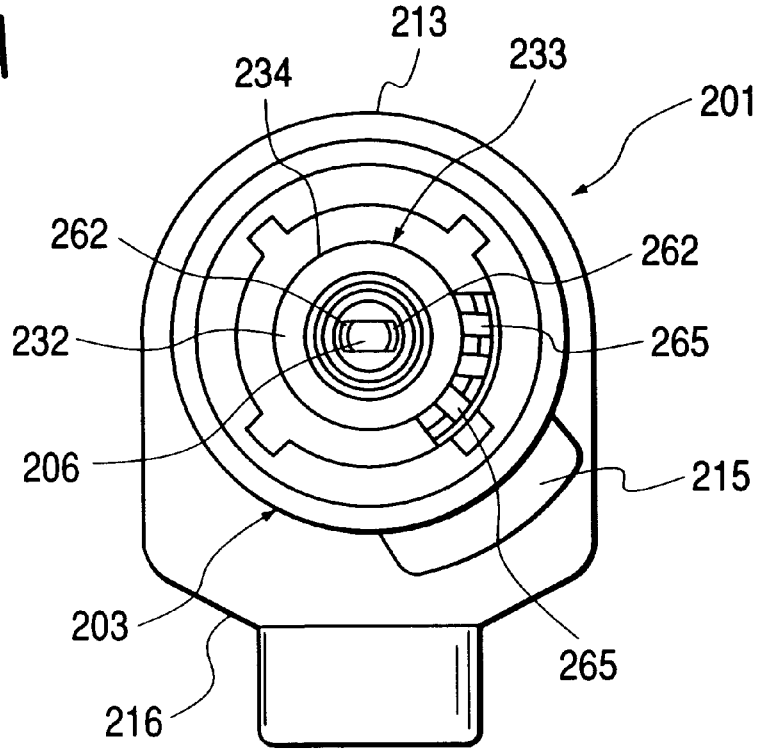
FIG. 23A is a plan view showing the vehicle-lamp lighting-on device.
Figure 23B:
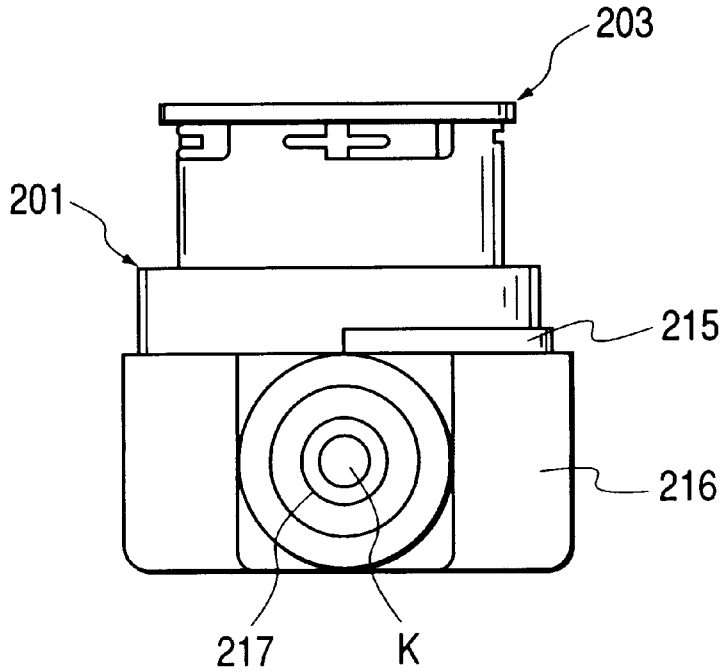
FIG. 23B is a side view showing the same.
Figure 24:
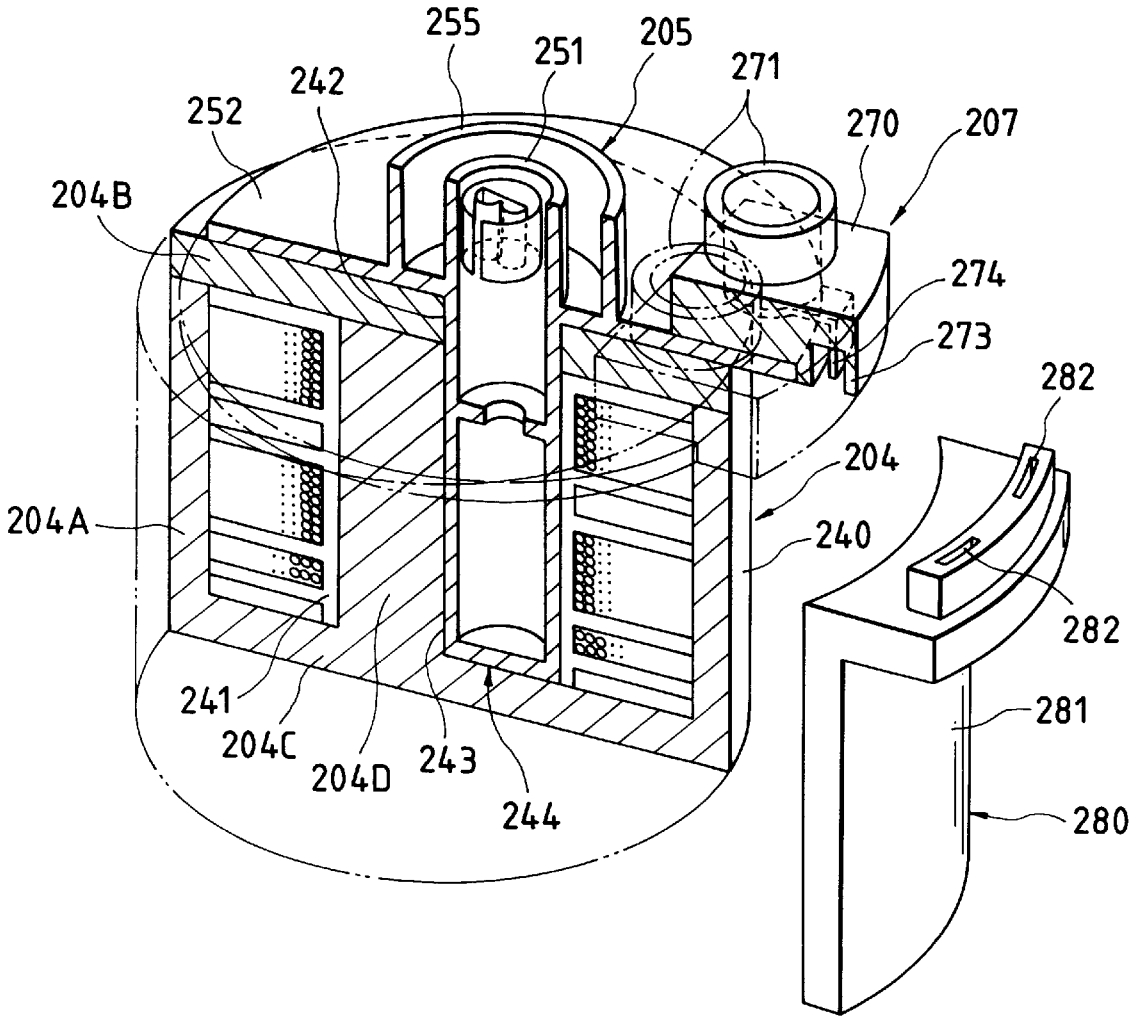
FIG. 24 is a sectional view in perspective of a portion of a transformer in the vehicle-lamp lighting-on device.

A construction of a vehicle-lamp lighting-on device 200, which is a third embodiment of the present invention, is illustrated in FIGS. 21 and 22. As shown, the vehicle-lamp lighting-on device 200 receives electric power from a power supply Vcc and supplies it to a discharge lamp L to light. Structurally, the vehicle-lamp lighting-on device 200 includes a housing 201 of synthetic resin and a circuit board 202 located in and fastened to a proper location (lower side of 211 in this embodiment) in the housing 201. A socket 203 is attached to an upper part 212 of the housing 201. The circuit board 202 is connected to the power supply Vcc, and various circuit components and circuitry for the secondary current generation are mounted and formed on the circuit board 202.

A transformer 204 is firmly mounted on the circuit board 202. The transformer 204 receives at its primary winding the output current from the primary current generating circuit, and boosts a voltage of the output current to a high-voltage of 13 to 20 kV. The socket 203 is detachably coupled with the transformer 204 in an insertion manner, by means of an insertion shaft 205 secured to the transformer 204. The discharge lamp L with a mount piece M formed around the neck part thereof is detachably attached to the socket 203. In this case, the socket 203 receives the mount piece M of the discharge lamp L.

The housing 201 is made of electrically insulating material of synthetic resin e.g., nylon, PBT, PPS, polyether imide, polyimide or the like. The housing 201 is a flat box-like block. When viewed from above or below, the box-like block is rectangular, and the outer edge (designated by numeral 213) of one half of the rectangle is circular. The circular outer wall of the housing 201 defined by the circular outer edge 213 is also designated by numeral 213. A cylindrical part 214 for receiving the socket 203 is located in the central part of the upper part 212 and protrudes upward from the upper part 212. The lower part of the socket 203 is inserted into the cylindrical part 214.

The upper part 212 of the housing 201 is horizontally expanded to form an expanded part 215. Presence of the expanded part 215 forms a space in the housing 201 in which relatively large circuit components and component parts, e.g., a socket earth terminal (ground) 207 (to be described later), capacitors, and the like are placed. A cable insertion hole 217 is formed in the outer wall 216 of the housing 201. A shielded cable K is inserted through the cable insertion hole 217 into the housing 201. The shielded cable K receives electrical power from the power supply Vcc and its shield is earthed (grounded). One end of the shielded cable K is connected to the circuit board 202, while the other end thereof is connected to a connector C.

The circuit board 202 is flat and configured in harmony with the shape of the lower side 211 of the housing 201. The circuit board 202 is fastened to a number of projections 218 on the upper part 212. The board fastening is performed after the earth (ground) terminals of a primary coil 245 and a secondary coil 246 from the transformer 204, are soldered to an earth (ground) terminal 221 of the circuit board 202. A circuit pattern from the primary current generating circuit is printed on the circuit board 202, and related electronic components, for example, resistors, capacitors, diodes and the like, are also mounted thereon. The earth terminal 221, which is formed at a given position on the circuit board 202, is earthed (grounded) through the shielded cable K.

The socket 203, like the housing 201, is made of electrically insulating material of synthetic resin e.g., nylon, PBT, PPS, polyether imide, polyimide or the like. The socket 203 includes a tubular part 230 and a partitioning wall 231 located at a position slightly lower than the middle of the socket 203 when longitudinally viewed. A mounting portion 232 for mounting the discharge lamp L is located above the partitioning wall 231. A high-voltage terminal tubular part 233 is raised from the central part of the mounting portion 232. The upper part of the tubular part 230, located above the mounting portion 232, is larger in its inside diameter to provide a reflecting-mirror coupling portion 234 in which the base of a reflecting mirror R is put.

The lower part of the socket 203, located under the partitioning wall 231, is enlarged in its inside diameter to provide an insertion chamber 235. Through-holes 236 are vertically formed through the partitioning wall 231 and the wall of the tubular part 230 surrounding the mounting portion 232, while interconnecting the reflecting-mirror coupling portion 234 and the insertion chamber 235. A tubular part 237 for the high-voltage terminal coupling is protruded from the underside of the partitioning wall 231 while being located at a position deviated to the circular outer wall 213 of the housing 201 from the center of the underside of the partitioning wall 231. Two tubular parts 238 for earth (ground) terminal coupling, while corresponding to the through-holes 236, protrude from the underside of the partitioning wall 231 at positions closer to the outer wall 216 of the housing 201, which are opposed to the circular outer wall 213 (when viewed from above).

A high-voltage terminal 206 is disposed in the tubular part 233. The high-voltage terminal 206 includes an intermediate coupling part 261, a couple of plate-like contacts 262 branched from the intermediate coupling part 261, and a plate-like lead 263 that is extended downward from the intermediate coupling part 261 below the partitioning wall 231. The plate-like lead 263 is inserted into an output terminal metal fitting 254 of the transformer 204 (to be described later).

A couple of earth (ground) terminals 265 are provided through the through-holes 236, outside the tubular part 233. Each earth (ground) terminal 265 includes a contact 266 protruded from the upper end of the corresponding through-hole 236 into the mounting portion 232, and a plate-like lead 67 protruded into the center of the corresponding tubular part 238. The plate-like leads 267 are respectively inserted into earth terminal metal fitting 272 of the socket earth terminal 207.

The transformer 204 is formed with a magnetic case 240 and a bobbin 241. The magnetic case 240 includes a cylindrical wall 204A, upper and lower walls 204B and 204C, and a center pole 204D. The bobbin 241 is placed within the magnetic case 240. A circular hole 242 is formed in the upper wall 204B which deviates from the center of the magnetic case 240. A cylindrical hole 243 is vertically formed in the center pole 204D, forming a cylindrical space 244.

The transformer 204 is mounted slightly deviated to the circular outer wall 213 of the housing 201 with respect to the cylindrical part 214. The axis of the cylindrical space 244 is also slightly deviated toward the circular outer wall 213 from the axis of the cylindrical part 214. The primary coil 245 and the secondary coil 246 are wound on the bobbin 241. The earth (ground) terminal of the secondary coil 246 is connected to the earth (ground) terminal 221 of the circuit board 202, through a hole 247 formed in the lower wall 204C.

The insertion shaft 205 is made of liquid crystal polymer (LCP), polyester imide, polyimide, or the like. The insertion shaft 205 includes an insulating body 253 having a hollowed shaft 251 and a disc-like part 252 radially extended from the hollowed shaft 251, and the output terminal metal fitting 254 is put in the upper part of the hollowed shaft 251. The hollowed shaft 251 is disposed such that the lower part thereof is installed in the cylindrical space 244 and the upper part protrudes upward. An outer tubular part 255 protrudes upward from the upper surface of the disc-like part 252, concentric with the hollowed shaft 251.

Figure 25:
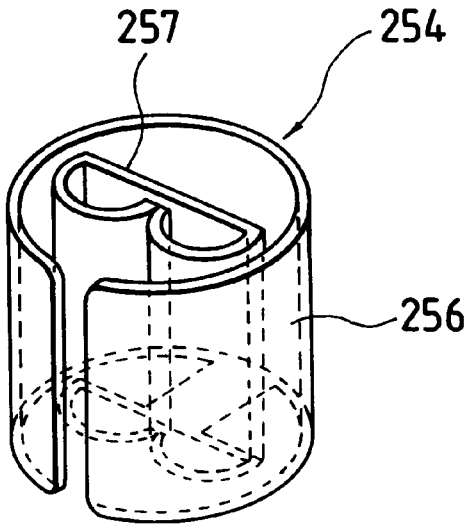
FIG. 25 is a perspective view showing output terminal metal fittings used in the vehicle-lamp lighting-on device.

The output terminal metal fitting 254 is connected to the secondary coil 246, through the lower part of the hollowed shaft 251. The output terminal metal fitting 254 is best illustrated in FIG. 25. The output terminal metal fitting 254 is formed by shaping metal sheets to have a cylindrical piece 256 and a slit terminal piece 257 located within the cylindrical piece 256. The cylindrical piece 256 is brought into resilient contact with the inner wall of the upper part of the hollowed shaft 251. A strip-like terminal is inserted into the slit terminal piece 257. The plate-like lead 263 of the high-voltage terminal 206 is inserted into the slit terminal piece 257.

The socket earth terminal 207 is provided on the upper surface of the disc-like part 252 of the insertion shaft 205 at a location close to the outer wall 216 of the housing 201. The socket earth terminal 207 includes a covering member 270 and two upper cylindrical parts 271 protrudes upward and located side by side on the covering member 270. Earth terminal metal fitting 272 are fit into the upper cylindrical parts 271, respectively. Each earth terminal metal fitting 272 has a structure similar to that of the output terminal metal fitting 254 shown in FIG. 25.

The covering member 270 is extended toward the outer wall 216 of the housing 201, and directed downward along the side wall of the transformer 204 to form lower cylindrical parts 273 directed downward. Plate-like terminals 274 are respectively provided within the lower tubular parts 273, while connecting respectively to the lower ends of the earth terminal metal fitting 272.

The plate-like terminals 274 of the socket earth terminal 207 are connected to an earth connector 208 and to the earth terminal 221 of the circuit board 202. The earth connector 208 includes a plate-like insulating member 281 having conductive members located therein, and slit terminals 282 provided in the upper end of the plate-like insulating member 281. The lower end of the plate-like insulating member 281 is connected to the earth terminal 221 of the circuit board 202.

Fourth Embodiment

A vehicle-lamp lighting-on device 301*a* which is a fourth embodiment of the present embodiment will be described with reference to the accompanying drawings.

Figure 26:
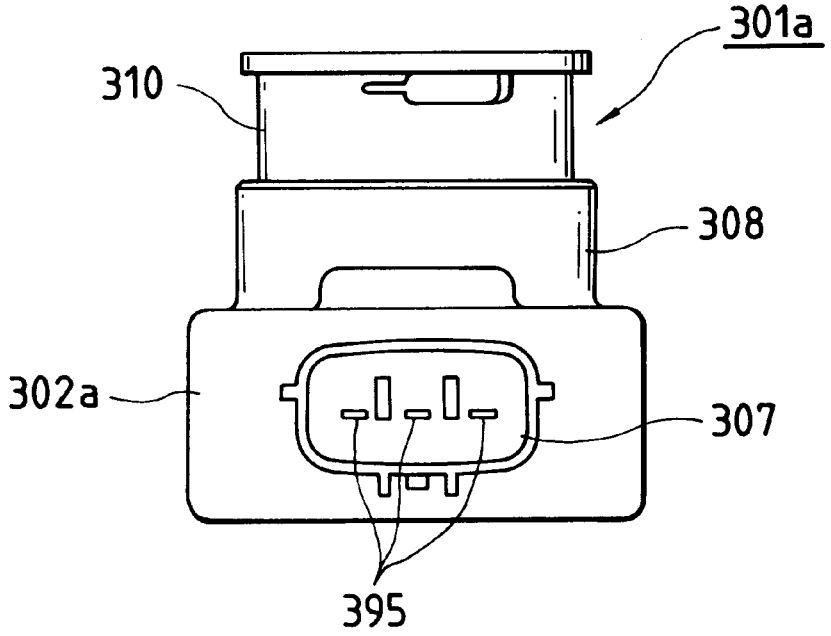
FIG. 26 is a front view showing a vehicle-lamp lighting-on device which is a fourth embodiment of the present invention.
Figure 27:
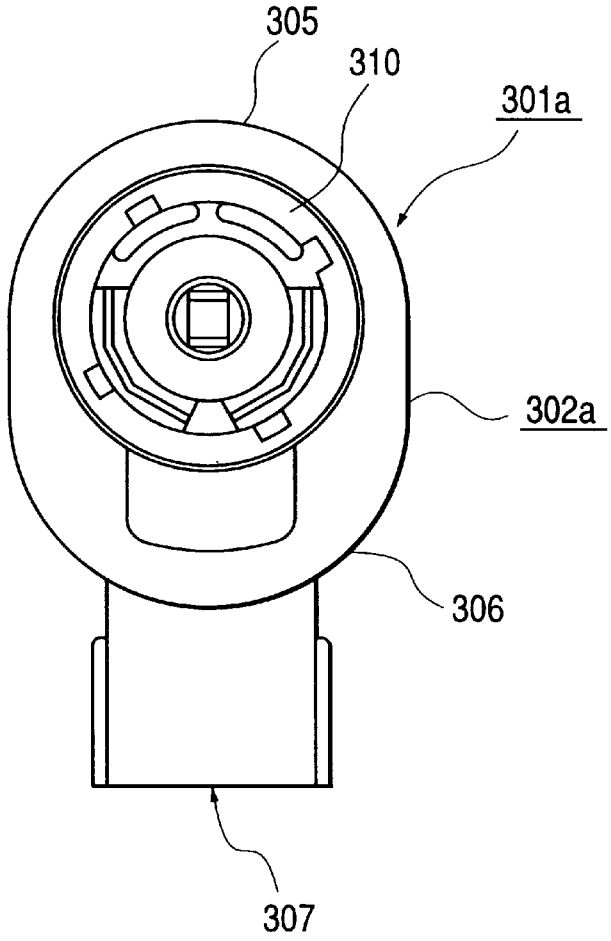
FIG. 27 is a plan view showing the vehicle-lamp lighting-on device.
Figure 28:
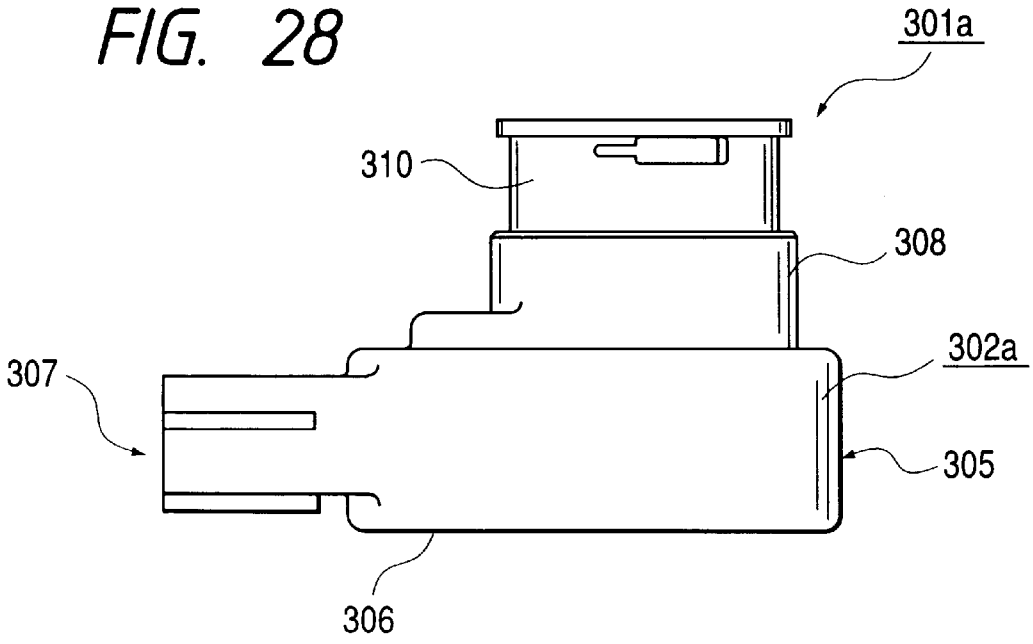
FIG. 28 is a side view showing the vehicle-lamp lighting-on device.

The vehicle-lamp lighting-on device 301*a*, as shown in FIG. 26, is generally made up of a body case 302*a*, a socket 310 and a lighting-on transformer 330, and the like. The body case 302*a* and the socket 310 are both made of synthetic resin.

Figure 29:
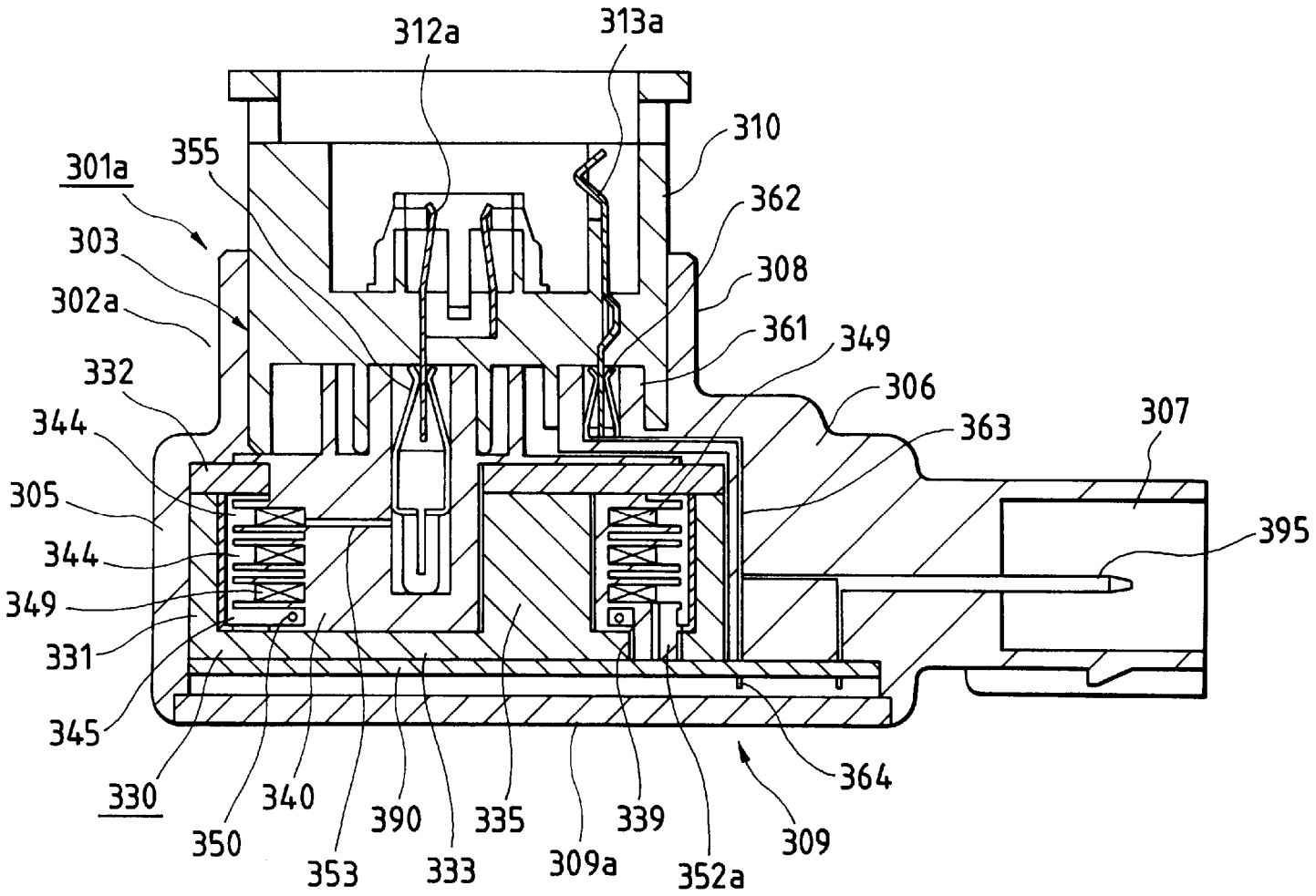
FIG. 29 is a longitudinal sectional view showing the vehicle-lamp lighting-on device when viewed from the left-hand side.
Figure 30:
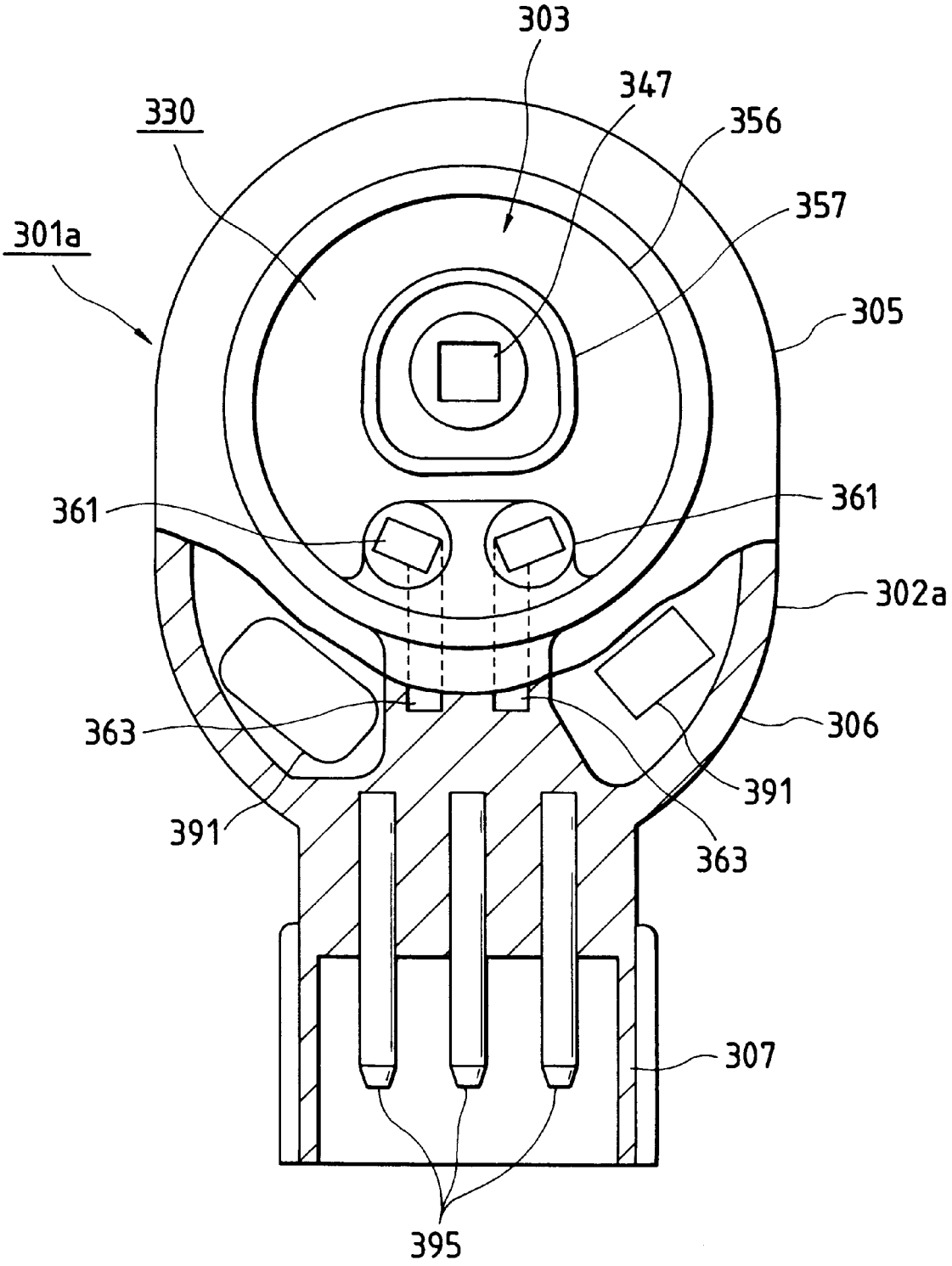
FIG. 30 is a side view, partly cut out, showing the vehicle-lamp lighting-on device when a socket is removed.

As shown in FIGS. 29 and 30, the synthetic resin body case 302*a* includes a major portion 305 and an extended portion 306 extended outwardly of the circular portion 305. The front end of the major portion 305 is opened to provide a circular connection opening 303 defined by a ring-like circumferential wall 308. The extended portion 306 is generally has a U-shape when viewed from above. A cylindrical protrusion, which has a through-hole 307 longitudinally formed therein, protrudes outward from the central part of the bottom of the U-shape of the extended portion 306. Lead wires are lead out through the through-hole 307 of the cylindrical protrusion. A printed circuit board 390 is placed on the bottom surface of the body case 302*a*. The printed circuit board 390 is connected to the inner ends of needle terminals 395. A space is formed in the extended portion 306 of the body case 302*a*. The space is used for mounting a circuit component 391, e.g., a condenser, on the printed circuit board 390. An opening 309 is formed in the rear side of the body case 302*a*. The lighting-on transformer 330, the printed circuit board 390 and other components installed in the body case 302*a*, through the opening 309. The opening 309 is covered with a cover 309*a*.

The socket 310, when attached, is inserted into the connection opening 303 of the major portion 305 of the body case 302*a*. The socket 310, cylindrical in shape, includes a high-voltage terminal 312*a* located at the central part thereof and a couple of low-voltage terminals 313*a* (FIG. 29), which are spaced outward from the high-voltage terminal 312*a*. The reason why two low-voltage terminals are used is that it is necessary to prevent an aerial discharge from taking place between the high-voltage terminal and the low-voltage terminals when the vehicle discharge lamp is not attached.

A construction of the lighting-on transformer 330 will be described with reference to FIGS. 29 through 32.

The lighting-on transformer 330 is constructed such that a coil bobbin 340 is placed in a core housing 331 having an iron core 335.

The core housing 331 is made of magnetic material, e.g., ferrite. A couple of core blocks 332 and 333, the outside diameters of which are equal, are coupled together to form a cylindrical body of a short length, or the core housing 331. The outside diameter of the cylindrical body is selected to be equal to the inside diameter of the circular portion 305 of the body case 302*a*. A specific example of the cylindrical body is 37 mm in diameter.

The core block 332 of the core housing 331 is a thin disc-like block approximately 2 mm thick. A coil bobbin 340 is injection molded onto the core block 332 forming a single unit.

Figure 31:
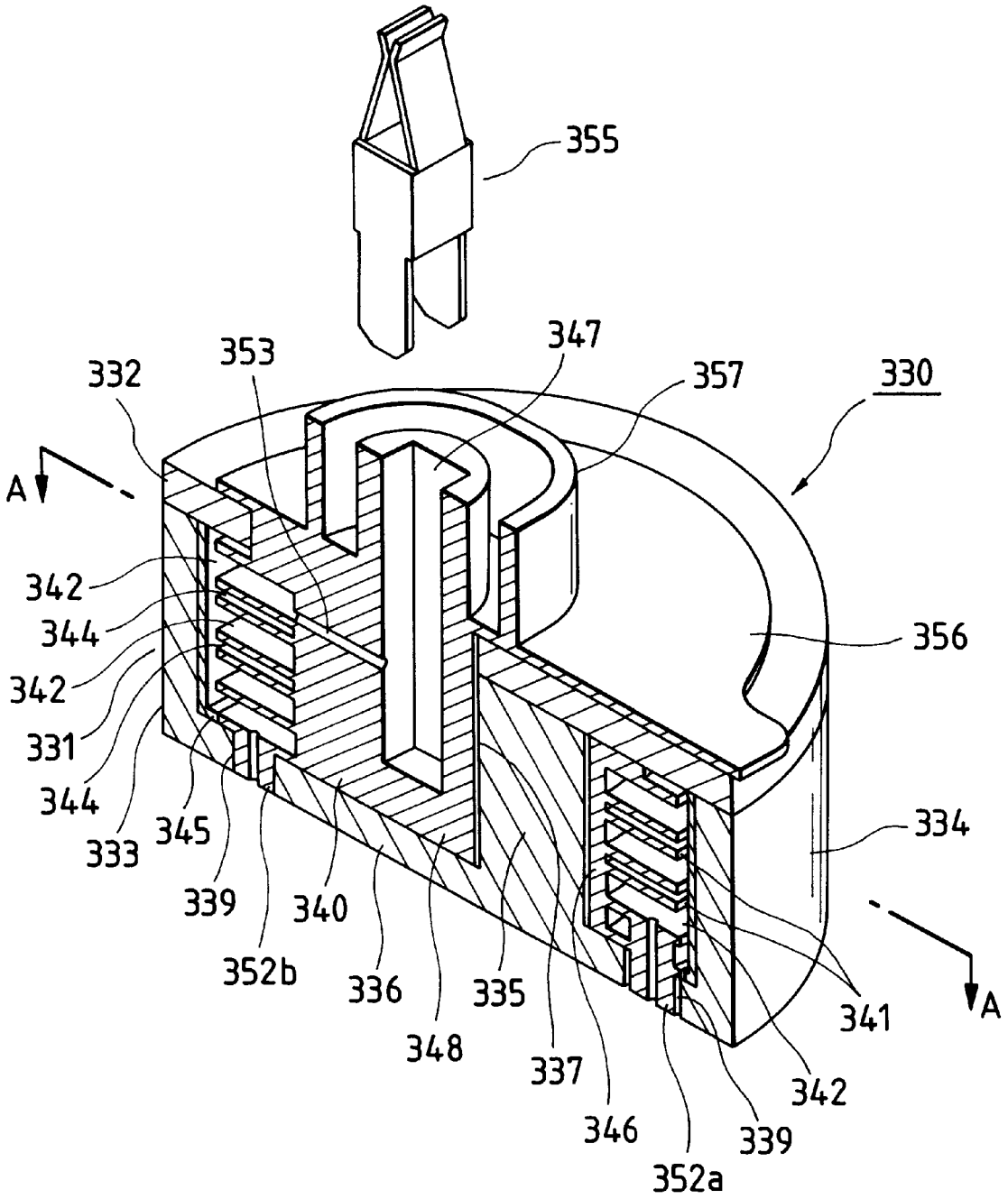
FIG. 31 is a longitudinal sectional view in perspective of a lighting-on transformer.
Figure 32:
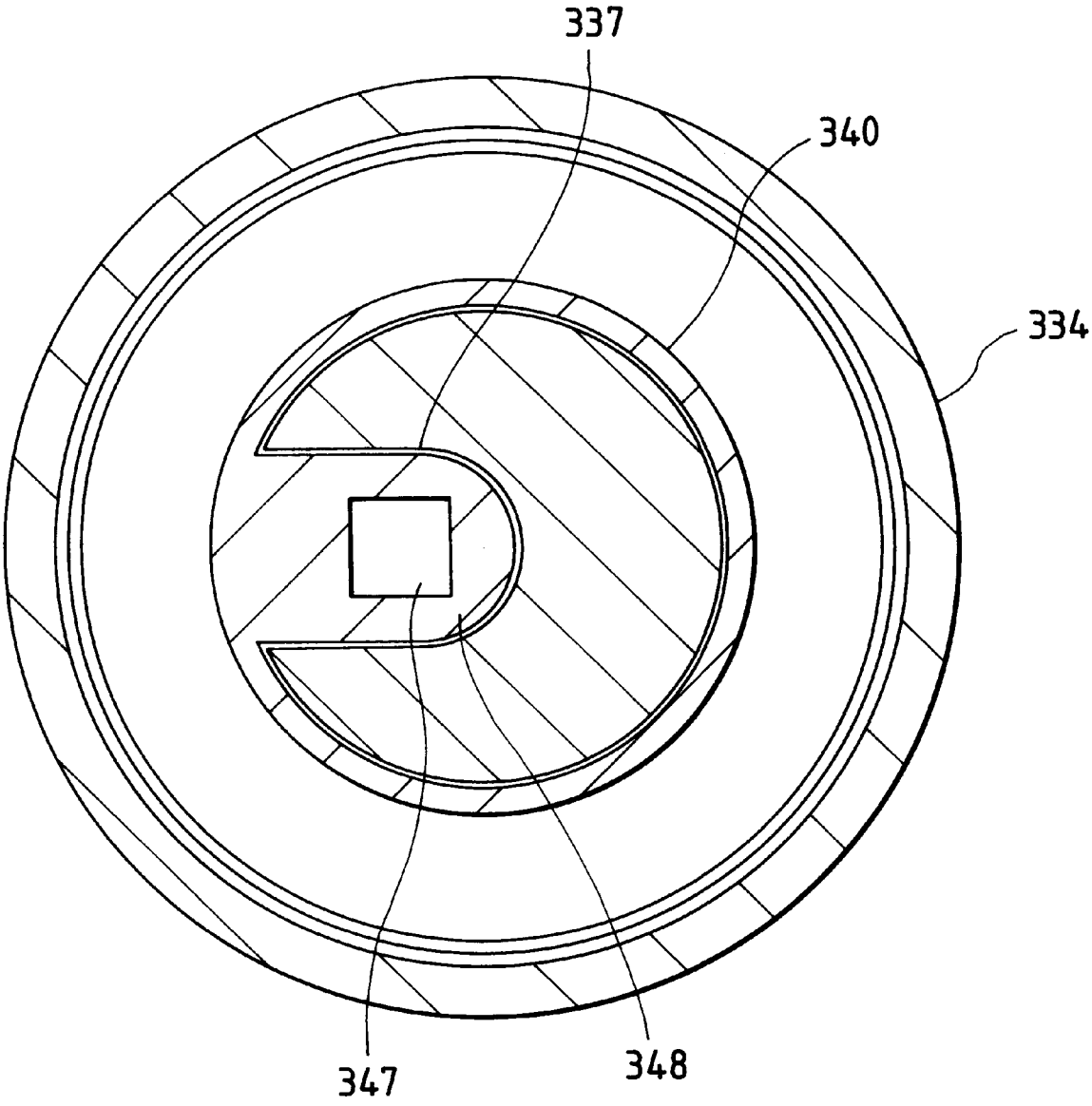
FIG. 32 is a cross sectional view taken on line A—A in FIG. 31.

The detail of the core block 333 of the core housing 331 is illustrated in FIG. 31. As shown, the core block 333 includes a cylindrical wall 334, an iron core 335 and a rear wall 336 which interconnects the cylindrical wall 334 and the iron core 335. The cylindrical wall 334 is raised vertically from the outer circumferential edge of the rear wall 336. The iron core 335 is raised vertically from the central part of the core block 333. A through-hole 337 extends through the iron core 335 in its lengthwise direction slightly deviated from the center of the core block 333. A thick portion 348 of the coil bobbin 340 (which will be described later) is inserted into the through-hole 337. The core block 333 is manufactured as a single component, and, in assembling, is applied to the rear side of the unit structure including the core block 332 and the coil bobbin 340 as will be described later. Three holes 339 are formed in the rear wall 336.

If required, the iron core 335 may be formed with the core block 332, which is located on the front side of the core block 333.

A construction of the coil bobbin 340 to be integrated with the core block 332 will be described.

Reference is made to FIG. 29. The coil bobbin 340 is made of synthetic resin. As shown, the coil bobbin 340 includes a cylindrical bobbin base 346 to be brought into close contact with the outer surface of the iron core 335. A plural number of flange-like plates 341 extend radially and outwardly from the outer surface of the cylindrical bobbin base 346. The flange-like plates 341 and the inner surface of the cylindrical wall 334 of the core block 333 define spaces 342, intermediate spaces 344 located between the spaces 342, and another space 345. A secondary coil 349 is successively wound in the spaces 342 and the intermediate space 344, and a primary coil 350 like a thin film is installed in the space 345.

As shown in FIG. 31, a protruded part 352*a* and another protruded part 352*b* (one of them is illustrated in the figure) protrude from the rear side of the coil bobbin 340. Those protruded parts 352*a* and 352*b* are inserted into the three holes 339 (two of them are illustrated in the figure) of the rear wall 336, whereby the coil bobbin 340 and the core block 333 are coupled together. Through-holes are formed in the protruded parts 352*a* and 352*b*. Both ends of the primary coil 350 are led out through the through-holes. The winding end terminal of the secondary coil 349 and both ends of the primary coil 350 are connected to related electrical paths on the printed circuit board 390.

The coil bobbin 340 is inserted into the through-hole 337 of the iron core 335; it has the thick portion 348 that passes through the core block 332; and a connection hole 347 is formed in the thick portion 348 deviated from the center of the coil bobbin 340. A shielding plate 356 that is continuous to the coil bobbin 340 is provided on the front side of the core block 332. The connection hole 347 is formed in the shielding plate 356. A cylindrical part 357 is raised from the shielding plate 356 concentric with the connection hole 347.

High-voltage side connecting terminal piece 355 is inserted into the connection hole 347 (FIG. 31). The winding start terminal (high voltage terminal) of the secondary coil 349 is introduced into the connection hole 347 through a through-hole 353 of the thick portion 348 and electrically connection to the high-voltage side connecting terminal piece 355. The secondary coil 349 is successively wound in the spaces 342 through the intermediate spaces 344, and the winding end terminal of the secondary coil is led out to the rear side of the lighting-on transformer 330, through the protruded part 352*a*.

In this way, the lighting-on transformer 330 is assembled.

Within the connection opening 303, a couple of cylindrical portions 361 are provided at locations close to the circumferential edge of the connection opening. Low-voltage side connecting pieces 362 are inserted into the cylindrical portions 361.

The cylindrical portions 361 are integral with the body case 302*a*. Low-voltage metal pieces (earthing paths) 363 are formed into the inner side of the body case 302*a* by insert molding. One end of each earthing path 363 is put in the corresponding cylindrical portion 361, and connected to the corresponding low-voltage side connecting piece 362. The other end 364 of the earthing path 363 is led to the rear side, passed through the corresponding through-hole, and connected to a low-voltage path (earthing path) on the printed circuit board 390.

To form the high-voltage side connecting terminal piece 355 or the each low-voltage side connecting piece 362, a metal sheet is bent into a triangular shape (in cross section) with its apex being opened. When the socket 310 is inserted into the connection opening 303, the high-voltage terminal 312*a* is inserted into the opening of the high-voltage side connecting terminal piece 355, and the two low-voltage terminals 313*a* are inserted into the openings of the low-voltage side connecting pieces 362, whereby electrical connection is set up.

Since the earthing paths 363 are formed into the body case 302*a* by insert molding, the vehicle-lamp lighting-on device 301*a* may be constructed in such a simple manner that the lighting-on transformer 330, the printed circuit board 390 and the like are inserted into the body case 302*a* through the opening 309, and the connection opening 303 is covered with the insulating shielding plate 356, and the socket 310 is inserted into and fixed to the connection opening 303.

In operation, voltage of about 400V is applied to the lead wires connected to the needle terminals 395 which extend into the through-hole 307. The voltage is applied to the primary coil of the lighting-on transformer through related circuitry on the printed circuit board 390. The transformer boosts the voltage to 13 kV or higher and the boosted voltage is applied from the secondary winding 349 to the high-voltage side connecting terminal piece 355 and in turn to the high-voltage terminal 312 of the socket 310.

Figure 33:
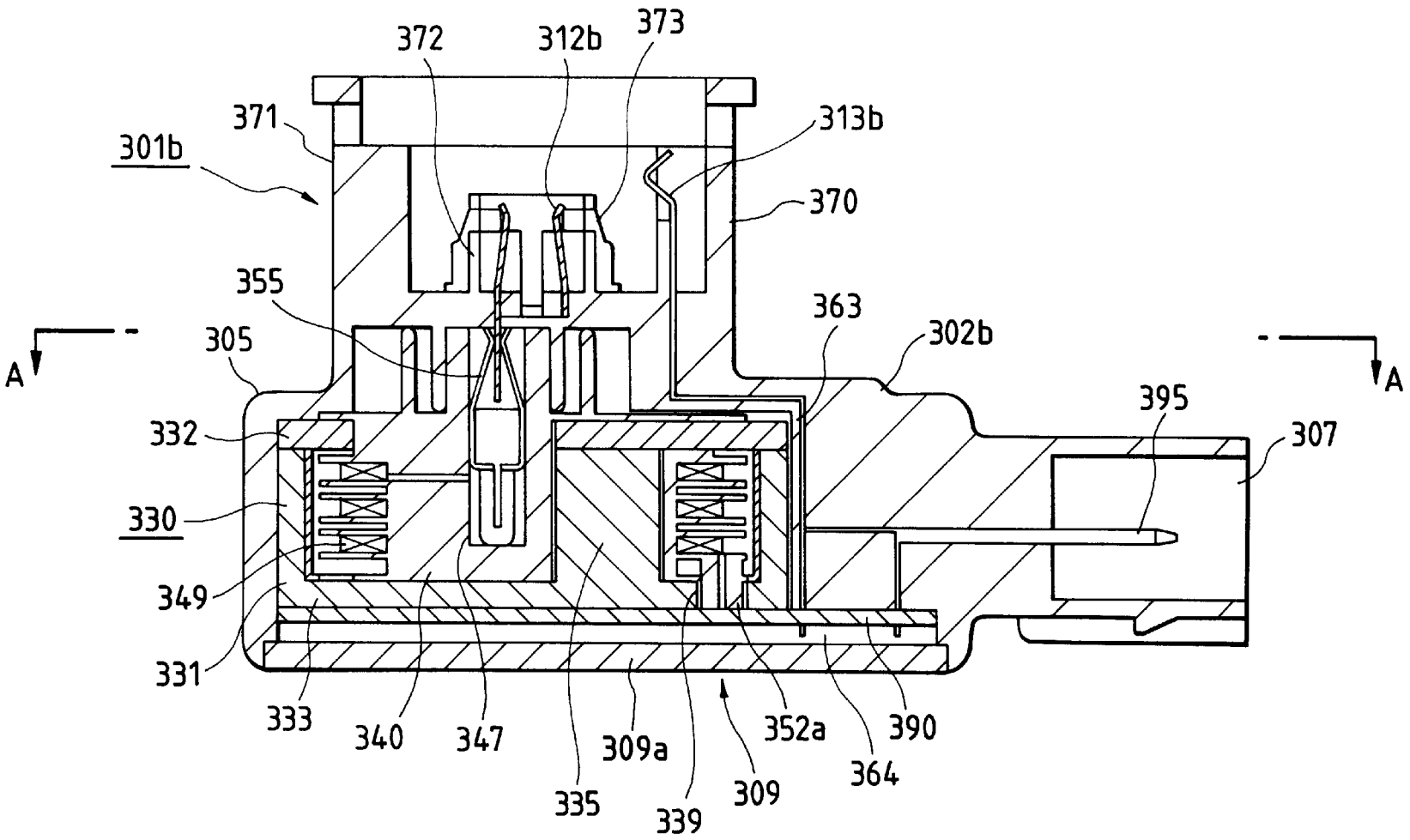
FIG. 33 is a longitudinal sectional view showing a vehicle-lamp lighting-on device when viewed from the left-hand side.
Figure 34:
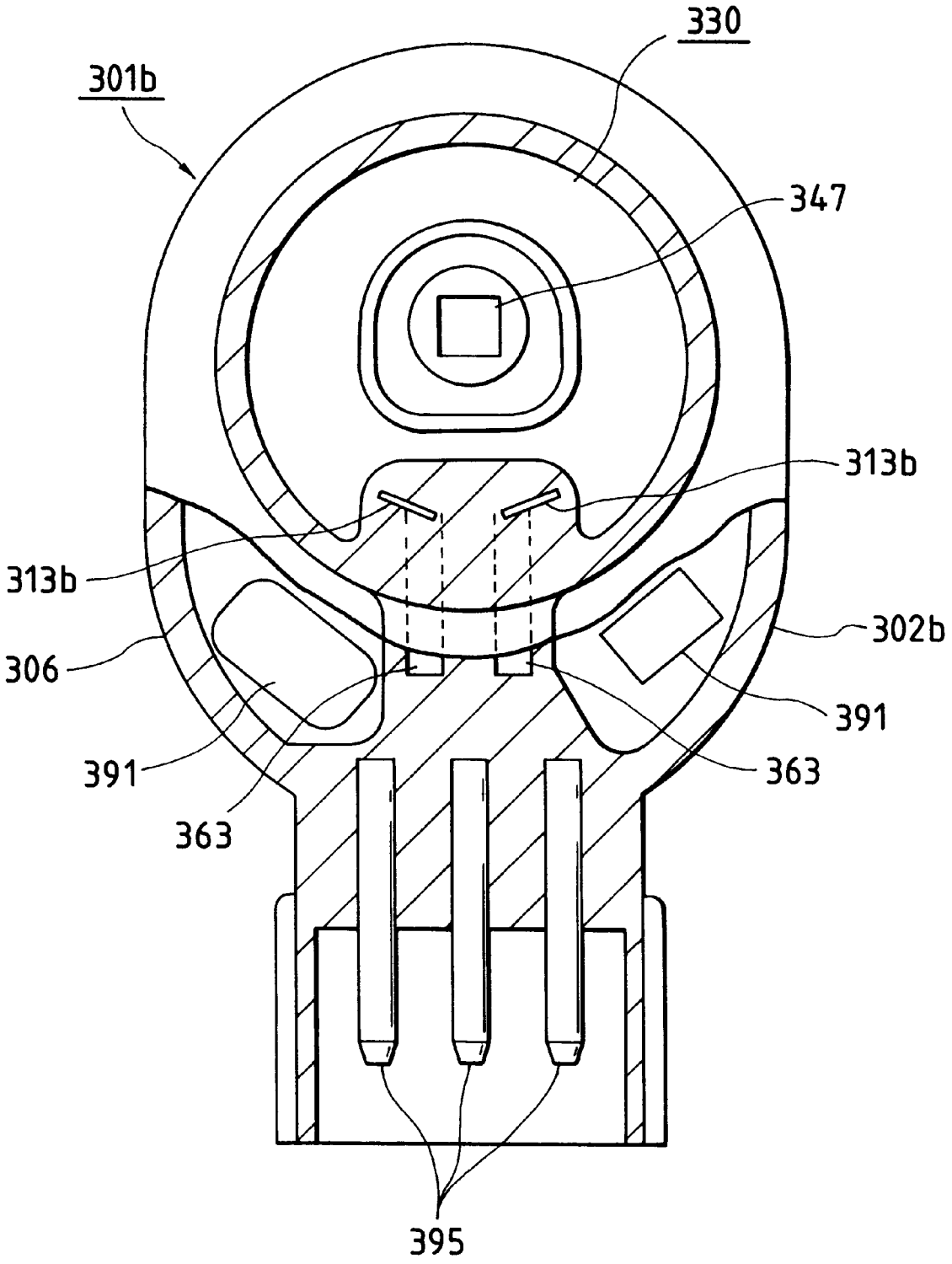
FIG. 34 is a cross sectional view, partially cut away, taken on line A—A in FIG. 33.

FIGS. 33 and 34 show a vehicle-lamp lighting-on device 301*b* which is a modified example of the fourth embodiment. In the figure, like or equivalent portions are designated by like reference numerals used in the fourth embodiment of the invention.

A major difference of the vehicle-lamp lighting-on device 301*b* from the vehicle-lamp lighting-on device la resides in that a socket 370 is integral with a body case 302*b*. As shown, the socket 370 is located on the front side of the major portion 305 of the body case 302*b*. The socket 370 includes a ring-like portion 371 into which the lamp is inserted and a small ring-like portion 372 located inside the ring-like portion 371. The ring-like portion 371 is integral with the small ring-like portion 372. The high-voltage terminal 312*b* is coupled into or onto the body case 302*b* by insert or outsert molding. Further, a rubber ring 373 is applied to the small ring-like portion 372. The low-voltage terminals 313*b* are coupled into the ring-like portion 371 by insert molding.

The lower end of the high-voltage terminal 312*b* is led from the socket 370 to the inside and connected to the opening of the high-voltage side connecting piece 355. The low-voltage terminals 313*b* are physically and electrically continuous to the earthing paths 363 coupled onto the body case 302*b*. (If required, those low-voltage terminals 313*b* may be formed as individual terminals. In this case, those terminals are connected to the earthing paths 363 by, for example, welding before insert molding is carried out.) Therefore, the low-voltage terminals 313*b* and the earthing paths 363 are insert-molded into one unit, with the end 364 of the earthing paths 363 being exposed on the rear side of the lighting-on transformer. When the printed circuit board 390 is set in place, the end 364 of the earthing paths 363 is passed through the through-hole and connected to the low-voltage path (earthing path) on the printed circuit board 390.

As described above, in the present embodiment, the low-voltage terminals 313*b* and the earthing paths 363 are coupled into the body case 302*b* by insert molding, and further the high-voltage terminal 312*b* is coupled into or onto the body case 302*b* by insert or outsert molding, whereby the socket 370 is integral with the bode case 302*b*. Therefore, the vehicle-lamp lighting-on device 301*b* may be constructed in such a simple manner that the lighting-on transformer 330, the printed circuit board 390 and the like are inserted into the body case 302*b* through the opening 309 thereof, and are attached to their correct positions within the body case 302*b*, and hence, the assembling of the body case 302*b* is easy.

The thus constructed vehicle-lamp lighting-on device (301*a*, 301*b*) is attached to the front of the engine compartment of a vehicle; a discharge lamp, e.g., a metal halide lamp, is attached to the socket (310, 370); the low-voltage terminals (313*a*, 313*b*) are connected to the peripheral electrodes of the discharge lamp; the high-voltage terminal (312*a*, 312*b*) is connected to the center electrode; and high voltage of 13 kV or higher is applied to the discharge lamp to light on the lamp.

As seen from the foregoing description, in a vehicle-lamp lighting-on device 301*a* constructed according to this embodiment, the low-voltage side connecting pieces 362 are inserted into the cylindrical portions 361 of the body case 302*a*, and put therein in a state that the low-voltage side connecting pieces 362 are exposed in the connection opening 303. The earthing paths 363 are connected at the first ends to the low-voltage side connecting pieces 362 and at the second ends to a low-voltage path on the printed circuit board 390, which is located in the rear part within the body case 302*a*. The earthing paths 363 are coupled into the inner side of the body case 302*a* by insert molding. Because of this, the vehicle-lamp lighting-on device may be constructed by merely setting the necessary components, for example, the lighting-on transformer 330, in the body case 302*a*, and attaching the socket 310 to the body case. Therefore, the vehicle-lamp lighting-on device is suitable for manufacturing by mass production.

In the vehicle-lamp lighting-on device 301*b* constructed according to another aspect of the invention, the socket 370 and the body case 302*b* are integrally formed into one unit such that the socket 370 is located on the front side of the body case 302*b*. The socket 370 includes the low-voltage terminals 313*b* insert-molded therein and the high-voltage terminal 312*b* also insert or outsert molded therein or thereon. Within the body case 302*b*, the high-voltage terminal 312*b* is electrically connected to the high-voltage side connecting piece 355 of the lighting-on transformer 330. Further, the low-voltage terminals 313*b* are electrically connected to the low-voltage path on the printed circuit board 390 that is located in the rear part within the body case 302*b*, through the earthing paths 363 insert-molded into the body case. Therefore, there is no need to manufacture the socket as a separate member, and the vehicle-lamp lighting-on device may be assembled by simply inserting the lighting-on transformer and others into the body case and to set them in place therein.

Fifth Embodiment

As described above, the vehicle-lamp lighting-on device according to the present invention has been described. Further, the present invention can employ the following structure.

Figure 35:
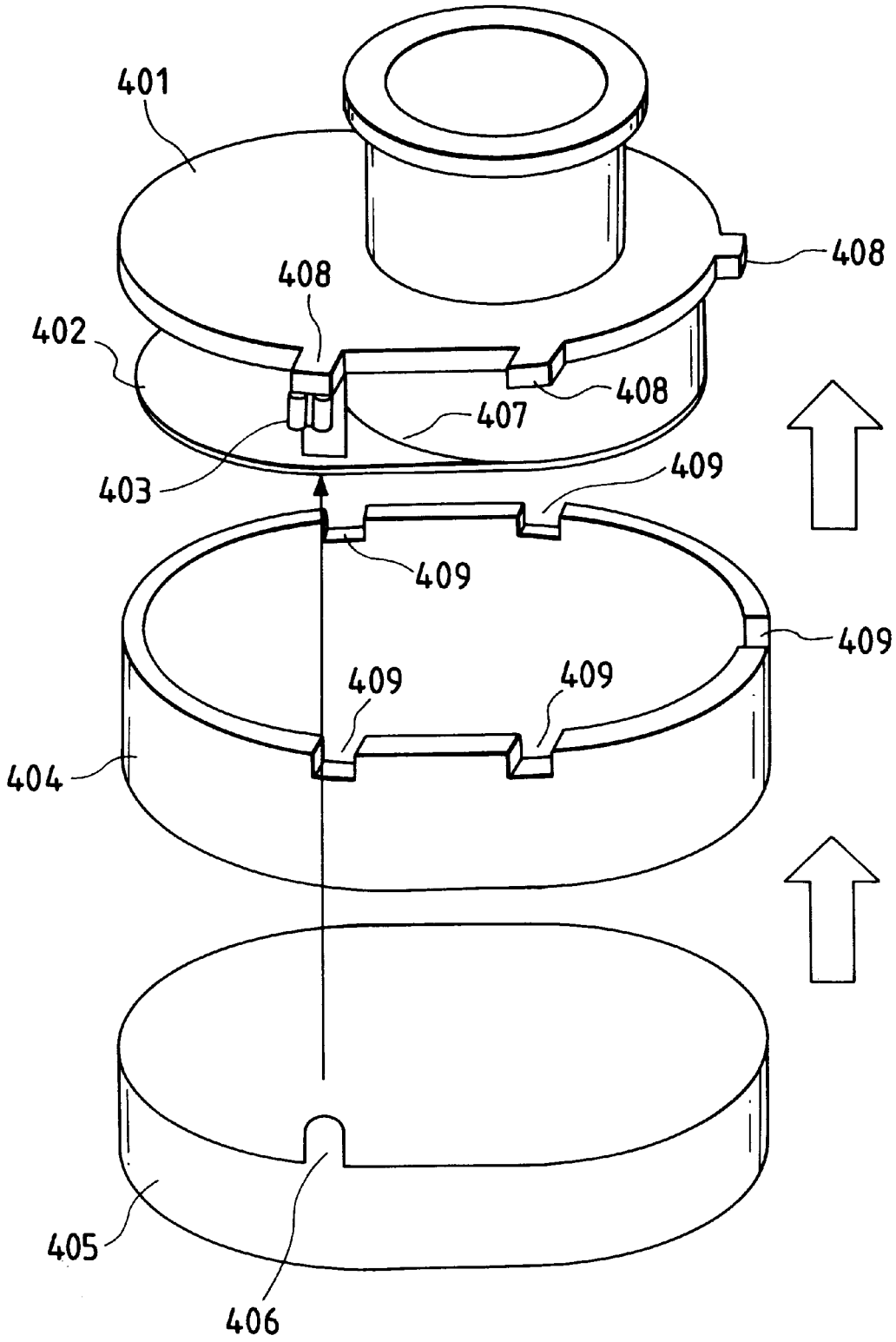
FIG. 35 is an exploded view showing a fifth embodiment according to the present invention.

Namely, as shown in FIG. 35, a socket 401 to which a discharge lamp (not shown) is connected and a print board 402 on which a control circuit and the like are mounted are connected by a shield wire 407. The shield wire 407 is connected with the socket 401 through a shield terminal 403. The circuit board 402 is received in a case 404 as well as convex portions 408 of the socket 401 are fixed with concave portions 409 of the case 404 so that the socket 401 is fitted to the case 404. Further, a metal cap 405 is installed onto the case 404 and an extruded portion 406 of the metal cap 405 is connected to the shield terminal 403.

According to this structure, it is possible to prevent noise emitted from a discharge lamp, a socket, a lighting-on unit and the like, and there is little possibility of interference by noise to electric equipment around the vehicle-lamp lighting-on device. Further, because the socket and the metal cap are integrally provided in the present invention, it is possible to simplify assembling processes and thereby reduce cost.

What is claimed is:

1. A vehicle-lamp lighting-on device comprising:

a body case including a connection opening formed in a front end thereof;

a lighting-on transformer being disposed within said body case, said lighting-on transformer comprising:

a core housing having an iron core;

a coil bobbin comprising an insulating material, said coil bobbin being installed outside of said iron core;

a secondary coil wound on an outer periphery of said coil bobbin;

a primary coil wound on a periphery of said iron core;

a high-voltage side terminal connected to said secondary coil;

low-voltage side terminals connected to a low-voltage path introduced into said body case, said high-voltage side terminal and said low-voltage side terminals being provided in a front surface of said lighting-on transformer;

an insulating shield plate provided in said front end of said body case for shielding said connection opening of said body case;

wherein said high-voltage side terminal and said low-voltage side terminals are exposed in said connection opening; and a socket connected to a vehicle lamp, in which a high-voltage terminal and low-voltage terminals are held by a ring-shaped holding piece comprising an insulating material;

wherein said socket is connected to said connection opening so that said high-voltage terminal and said low-voltage terminals are connected to said high-voltage side terminal and said low-voltage side terminals, respectively.

2. A vehicle-lamp lighting-on device comprising:

a body case including a connection opening formed in a front end thereof;

a lighting-on transformer being disposed within said body case, said lighting-on transformer comprising:

a core housing having an iron core;

a coil bobbin comprising an insulating material, said coil bobbin being installed outside of said iron core;

a secondary coil wound on an outer periphery of said coil bobbin;

a primary coil wound on a periphery of said iron core;

wherein said lighting-on transformer is received in said body-case;

a socket connected to said connection opening of said body case, said socket having a high-voltage terminal which is connected to a high-voltage end of said secondary coil;

a front end plate which is provided in a front of said coil bobbin so that an insertion gap is formed between said front end plate and a bobbin main portion of said coil bobbin for carrying said secondary coil;

wherein said core housing comprises a plate-shaped core block having a thickness equal to said insertion gap and a cylindrical core block formed of a cylindrical wall and a rear wall which interconnects said cylindrical wall and said iron core, said plate-shaped core block is inserted into said gap between said bobbin main portion and said front end plate; and said cylindrical core block is installed outside of said bobbin main portion.

3. A vehicle-lamp lighting-on device comprising:

a body case made of insulating material;

a circuit board mounted in said body case, a primary current generating circuit connected to a power supply being mounted on said circuit board;

a transformer, located on said circuit board, for boosting a voltage of the primary current to generate a secondary voltage; and a socket having a high-voltage terminal for receiving said secondary voltage from said transformer and an earth terminal, said socket being provided on one end surface of said body case and adapted to receive a discharge lamp such that a portion of said discharge lamp is disposed outside of said body case;

wherein leads for said high-voltage terminal and said earth terminal extend downward through a bottom wall of said socket, and are inserted into said high-voltage terminal and said earth terminal.

4. The vehicle-lamp lighting-on device according to claim 1, wherein said transformer further comprises a magnetic case which covers said bobbin, an insulating hollowed shaft which protrudes from an upper surface of said magnetic case, said insulating hollowed shaft having an output terminal metal fitting to which leads of said high-voltage terminal are inserted;

further wherein said low-voltage side terminals are located on an upper end surface of said magnetic case, and said magnetic case includes a relay earth insulating member having an upper cylindrical part including an output terminal metal fitting therein into which leads of said low-voltage terminals of said socket are inserted.

5. The vehicle-lamp lighting-on device according to claim 4, wherein said relay earth insulating member has lower tubular parts which are disposed on a side wall of said magnetic case, and a plate-shaped terminal metal fitting mounted in said lower tubular parts, said plate-shaped terminal metal fitting inserted into a connector connected to said circuit board to ground said socket.

6. The vehicle-lamp lighting-on device according to claim 5, wherein two said low-voltage terminals are provided within said socket, and said relay earth insulating member includes said lower tubular part holding said plate-shaped terminal metal fitting therein for connection with said low-voltage terminals of said socket.

7. The vehicle-lamp lighting-on device according to claim 3, wherein said housing has a socket receiving cylindrical part in the upper part thereof, and the lower part of said socket is inserted into said socket receiving cylindrical part.

8. A vehicle-lamp lighting-on device comprising:

a body case having a connection opening formed in a front end thereof;

a lighting-on transformer comprising:

a core housing having an iron core;

a coil bobbin comprising an insulating material, said coil bobbin being installed outside of said iron core;

a secondary coil wound on an outer periphery of said coil bobbin;

a primary coil wound on a periphery of said iron core;

a high-voltage side connecting terminal connected to said secondary coil;

wherein said lighting-on transformer is disposed within said body case, and said high-voltage side connecting terminal is exposed to said connection opening;

a low-voltage side connecting terminal fixed to a fixing portion formed on said body case, which is exposed in said connection opening;

a low-voltage path member in which one end is connected to said low-voltage side connecting terminal and the other end is connected to a low-voltage path on a print board stored in a rear portion of said body case, said low-voltage path member being integrally held in said body case by insert molding; and a socket for receiving a vehicle discharge lamp, said socket having a ring-like holder made of insulating material for holding a high-voltage terminal and low voltage terminals;

wherein said socket is inserted into and attached to said connection opening so that said high-voltage terminal is connected to said high-voltage side connecting terminal and said low-voltage terminals are connected to said low-voltage side connecting terminal.

9. A vehicle-lamp lighting-on device comprising:

a body case having a connection opening formed in a front end thereof;

a lighting-on transformer comprising:

a core housing having an iron core;

a coil bobbin comprising an insulating materials, said coil bobbin being installed outside of said iron core;

a secondary coil wound on an outer periphery of said coil bobbin;

a primary coil wound on a periphery of said iron core;

a high-voltage side connecting terminal connected to said secondary coil;

wherein said lighting-on transformer is disposed within said body case; and a socket which is integrally formed with said body case such that said socket is located on a front side of said body case, said socket having low-voltage terminals integrally molded and a high-voltage terminal integrally molded therein, a vehicle discharge lamp being attached to said socket, within said body case;

wherein said high-voltage terminal is electrically connected to said high-voltage side connecting terminal of said lighting-on transformer, and said low-voltage terminals are electrically connected to a low-voltage path on a printed circuit board that is located in a rear part within said body case through earthing path members insert molded into said body case.

10. A vehicle-lamp lighting-on device according to any one of claims 1 to 9, further comprising a metal cap wherein a shield cable is used to connect a control circuit with said socket, wherein said metal cap is fitted to said body case, and said metal cap is connected to said shield cable.

* * * * *